US009063461B2

(12) United States Patent
Kubo et al.

(10) Patent No.: US 9,063,461 B2
(45) Date of Patent: Jun. 23, 2015

(54) IMAGE FORMING APPARATUS PROVIDED WITH AN AGITATION MEMBER CONFIGURED TO BE ROTATED

(71) Applicant: CANON KABUSHIKI KAISHA, Tokyo (JP)

(72) Inventors: Yukio Kubo, Kawasaki (JP); Masaaki Sato, Yokohama (JP); Masatoshi Yamashita, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/932,854

(22) Filed: Jul. 1, 2013

(65) Prior Publication Data

US 2014/0010561 A1 Jan. 9, 2014

(30) Foreign Application Priority Data

Jul. 9, 2012 (JP) ..... 2012-153651

(51) Int. Cl.
*G03G 15/08* (2006.01)
*G03G 15/00* (2006.01)

(52) U.S. Cl.
CPC ..... *G03G 15/0839* (2013.01); *G03G 15/0806* (2013.01); *G03G 15/0889* (2013.01); *G03G 15/5008* (2013.01); *G03G 15/55* (2013.01); *G03G 15/0865* (2013.01); *G03G 15/0875* (2013.01); *G03G 15/0877* (2013.01); *G03G 15/0896* (2013.01)

(58) Field of Classification Search
USPC ..... 399/38, 53, 107, 110, 111, 113, 399/252–263, 119, 120
See application file for complete search history.

(56) References Cited

U.S. PATENT DOCUMENTS 7,979,006 B2 * 7/2011 Sato et al. ..... 399/254

FOREIGN PATENT DOCUMENTS

| | | | |
|---|---|---|---|
| JP | 05-080651 | A | 4/1993 |
| JP | 2002-296905 | A | 10/2002 |
| JP | 2006-119479 | A | 5/2006 |

* cited by examiner

*Primary Examiner* — Hoan Tran
(74) *Attorney, Agent, or Firm* — Canon USA Inc. IP Division

(57) ABSTRACT

An image forming apparatus configured to form an image on a recording medium, includes a developer container configured to store developer, an image bearing member configured to be rotated and on which a latent image is formed, a developer bearing member configured to bear developer and to be rotated to develop the latent image, an agitation member configured to be rotated to agitate the developer stored in the developer container, and a control unit configured to control the rotations of the image bearing member, the developer bearing member, and the agitation member so as to rotate the agitation member while the image bearing member is not rotated.

20 Claims, 13 Drawing Sheets

IMAGE FORMING APPARATUS PROVIDED WITH AN AGITATION MEMBER CONFIGURED TO BE ROTATED

BACKGROUND OF THE INVENTION

1. Field of the Invention

The present invention relates to an image forming apparatus and a process cartridge used for the image forming apparatus.

Herein, the image forming apparatus is an apparatus that forms an image on a recording medium by using an electrophotographic method.

In addition, examples of the image forming apparatus include copying machines, printers (e.g., laser beam printers, LED printers), facsimile machines, and word processors that use the electrophotographic method.

2. Description of the Related Art

In an electrophotographic image forming apparatus (hereinbelow, also simply referred to as an image forming apparatus), an electrophotographic photosensitive member (hereinbelow, also simply referred to as a photosensitive member) as an image bearing member is uniformly charged. Then, the charged photosensitive member is selectively exposed to light according to image information, and an electrostatic image (electrostatic latent image) is formed on the photosensitive member. The electrostatic image is developed (visualized) as a toner image (developer image) with developer. Then, the toner image is transferred to a recording medium. Thereafter, the toner image is fixed and recorded to the recording medium by adding heat and pressure to the recording medium to which the toner image is transferred.

In the image forming apparatus, in order to form an image, the photosensitive member of a process cartridge mounted on the image forming apparatus main body and a process unit (process member) acting on the photosensitive member need to be rotated. The photosensitive member and process unit are subjected to electrostatic or physical actions respectively by elements such as other process units. Therefore, a specific torque is needed to rotate the photosensitive member or the process unit.

The torque required for the rotation may vary due to the influence of the rotation period of the photosensitive member or the process unit. However, during image formation, if fluctuation of torque occurs, the rotational circumferential speed of the photosensitive member or the developer bearing member serving as the process unit may vary to cause image defect such as density unevenness or pitch unevenness.

Therefore, Japanese Patent Application Laid-open No. 05-080651 discusses a technique in which a drive path of an agitation member, which is susceptible to a load fluctuation caused by agglutination of developer, is provided in a different route from the drive path of the photosensitive member or the developer bearing member.

However, with the above-described conventional configuration, if the developer bearing member and the agitation member are driven at a same time during image formation, a common drive source mounted in the image forming apparatus main body needs to provide a drive torque of the agitation member in addition to a drive torque of the developer bearing member.

Therefore, in order to reduce the influence of the variation of the rotation period of the developing unit as described above, a power source that can supply larger power is required, resulting in increase in cost or power consumption.

This applies to a case where drive sources are provided independently for driving the developer bearing member and the agitation member.

In addition, not limited to the developer bearing member, the same problem may occur when the photosensitive member (image bearing member) and the agitation member are driven at a same time.

SUMMARY OF THE INVENTION

The present invention is directed to an image forming apparatus and a process cartridge capable of performing stable image formation without being influenced by the driving load fluctuation of an agitation member while preventing an increase in cost and power consumption of a power source.

According to an aspect of the present invention, an image forming apparatus configured to form an image on a recording medium, includes a developer container configured to store developer, an image bearing member configured to be rotated and on which a latent image is formed, a developer bearing member configured to bear developer and to be rotated to develop the latent image, an agitation member configured to be rotated to agitate the developer stored in the developer container, and a control unit configured to control the rotations of the image bearing member, the developer bearing member, and the agitation member so as to rotate the agitation member while the image bearing member is not rotated.

Further features of the present invention will become apparent from the following description of exemplary embodiments with reference to the attached drawings.

DESCRIPTION OF THE EMBODIMENTS

An image forming apparatus and a process cartridge according to an exemplary embodiment are described in more detail below with reference to the drawings.

1. Overall Configuration of Image Forming Apparatus

First, an overall configuration of an image forming apparatus according to a first exemplary embodiment is described.

In the present exemplary embodiment, a full color image forming apparatus with four attachable/detachable process cartridges is exemplified as an image forming apparatus. However, the number of process cartridges mounted on the image forming apparatus is not limited thereto, and can be determined as needed. For example, in a case of an image forming apparatus that forms monochrome images, the number of process cartridges to be mounted thereon is one. In addition, in the present exemplary embodiment, a printer is exemplified as an example of an image forming apparatus. However, it is not limited thereto. For example, the present invention can be applied to other image forming apparatuses such as copying machines, facsimile machines, or multifunction peripherals including these functions.

Figure 1:
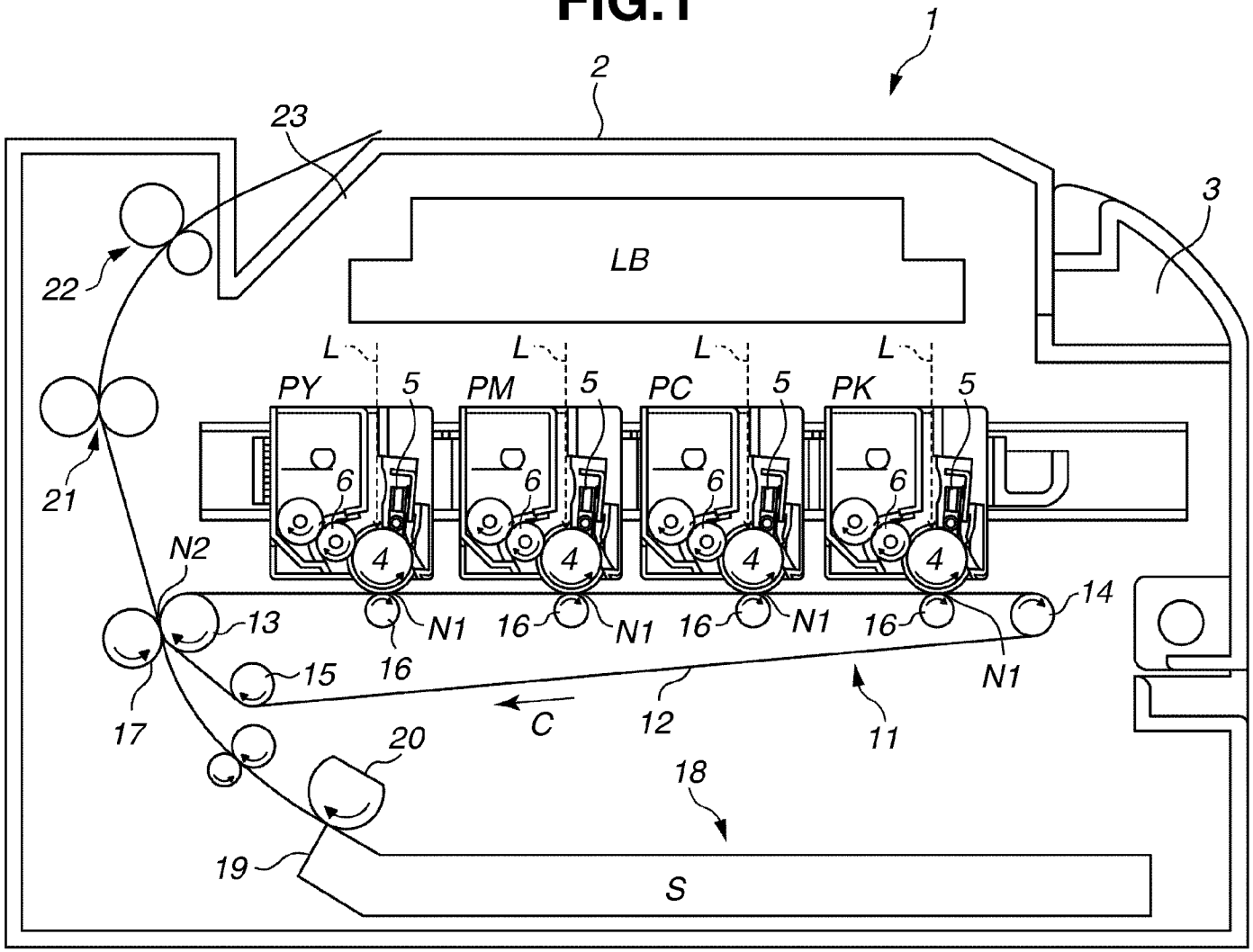
FIG. 1 is a cross-sectional view schematically illustrating an image forming apparatus.

FIG. 1 is a cross-sectional view schematically illustrating an image forming apparatus 1 according to the present exemplary embodiment. In the present exemplary embodiment, the image forming apparatus 1 is a full color (i.e., four color) laser printer employing the electrophotographic process, and can form a full color image on a recording medium (recording material) S. Further, in the present exemplary embodiment, the image forming apparatus 1 employs a process cartridge system, and process cartridges PY, PM, PC, and PK are detachably mounted on a main body (apparatus main body) 2 of the image forming apparatus 1. Thus, the image forming apparatus 1 can perform image formation on the recording medium S.

In the present exemplary embodiment, a side of the image forming apparatus 1 with an open/close door 3 is referred to as a front side, and the opposite side of the front side thereof is referred to as a back side. Further, the right side of the image forming apparatus 1 viewed from the front side is referred to as a driving side, and the left side thereof is referred to as a non-driving side.

In the apparatus main body 2, four process cartridges of a first process cartridge PY, a second process cartridge PM, a third process cartridge PC, and a fourth process cartridge PK are disposed in substantially a horizontal direction. The first to fourth process cartridges PY, PM, PC, and PK include a similar electrophotographic process mechanism, but toner colors used as a developer are different from each other. In the present exemplary embodiment, when a process cartridge for each color is not to be discriminated, it is simply referred to as a "process cartridge P".

To the process cartridge P, the rotation drive force is transmitted from a drive output unit (described below) of the apparatus main body 2. Further, to the process cartridge P, a bias voltage (e.g., charging bias, developing bias) is applied from a bias power source (not illustrated) of the apparatus main body 2.

Figure 2:
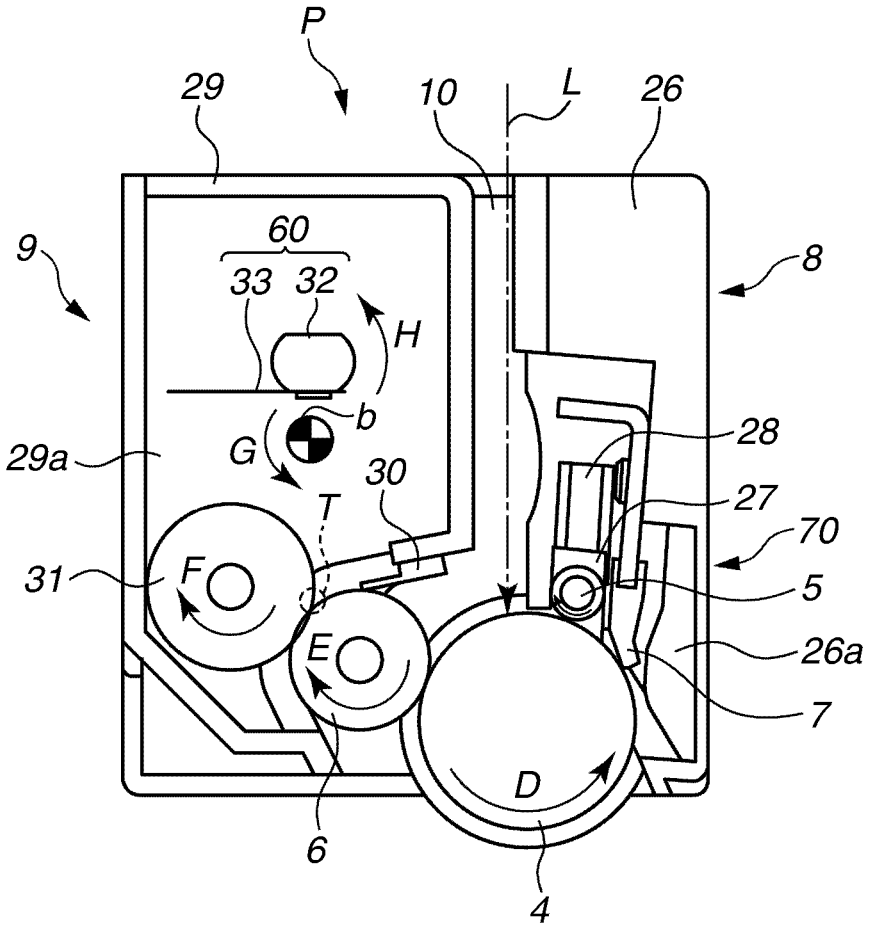
FIG. 2 is a cross-sectional view schematically illustrating a process cartridge.

As illustrated in FIG. 2, the process cartridge P includes a photosensitive drum 4 as an image bearing member. The photosensitive drum 4 is a drum type electrophotographic photosensitive member (photosensitive member). The photosensitive drum 4 is a member for bearing an image thereon. On the surface of the photosensitive drum 4, an electrostatic image and a developer image (toner image) are formed. The details are described below. The photosensitive drum 4, a charging unit serving as a process unit (process device, process member) acting on the photosensitive drum 4, and a cleaning unit are held in a cleaning unit 8. Further, the process cartridge P includes a developing unit (developing device) 9 provided with a developing unit (developing member) for developing an electrostatic latent image on the photosensitive drum 4. The cleaning unit 8 and the developing unit 9 are connected to each other.

In the present exemplary embodiment, a charging roller 5, which is a roller type charging member, is used as a charging unit, a cleaning blade 7 is used as a cleaning unit, and a developing roller 6, which is a developer bearing member, is used as a developing unit (developing member). More specific configuration of the process cartridge P will be described below.

The first process cartridge PY stores yellow (Y) toner in a developer container 29 and forms a yellow toner image on the surface of the photosensitive drum 4. The second process cartridge PM stores magenta (M) toner in the developer container 29 and forms a magenta toner image on the surface of the photosensitive drum 4. The third the process cartridge PC stores cyan (C) toner in the developer container 29 and forms a cyan toner image on the surface of the photosensitive drum 4. The fourth the process cartridge PK stores black (K) toner in the developer container 29 and forms a black toner image on the surface of the photosensitive drum 4.

Above the first to fourth process cartridges PY, PM, PC, and PK in FIG. 1, a laser scanner unit LB as an exposure unit is provided. The laser scanner unit LB emits a laser beam L according to image information. The laser beam L passes through an exposure window portion 10 of the process cartridge P to scan the surface of the photosensitive drum 4 for exposure.

Below the first to fourth process cartridges PY, PM, PC, and PK in FIG. 1, an intermediate transfer belt unit 11 is provided as a transfer device. The intermediate transfer belt unit 11 includes a drive roller 13, a turn roller 14, and a tension roller 15, and a flexible intermediate transfer belt 12 (endless belt) is stretched around these rollers as an intermediate transfer member.

The peripheral surface of the photosensitive drums 4 of the first to fourth process cartridges PY, PM, PC, and PK are brought into contact with the surface of the intermediate transfer belt 12. In the present exemplary embodiment, in a state where the process cartridge P is mounted on the apparatus main body 2, the bottom surface of the photosensitive drum 4 is brought into contact with the upper surface of the intermediate transfer belt 12. The contact portion is a primary transfer portion N1.

On the inner peripheral surface side of the intermediate transfer belt 12, primary transfer rollers 16 are disposed respectively facing photosensitive drums 4 of the first to fourth process cartridges PY, PM, PC, and PK. The primary transfer roller 16 presses the intermediate transfer belt 12 to the photosensitive drum 4 to form a primary transfer portion N1. The primary transfer portion N1 is a contact portion of the intermediate transfer belt 12 and the photosensitive drum 4. A secondary transfer roller 17 (i.e., secondary transfer unit) is brought into contact with the drive roller 13 via the intermediate transfer belt 12. The contact portion of the intermediate transfer belt 12 and the secondary transfer roller 17 is a secondary transfer portion N2.

Below the intermediate transfer belt unit 11 in FIG. 1, a feeding unit 18 is disposed. The feeding unit 18 includes a paper feed tray 19 storing recording media S stacked therein, and a sheet feeding roller 20.

Upper left portion within the apparatus main body 2 in FIG. 1, a fixing unit 21 and a discharge unit 22 are provided. Further, the top surface of the apparatus main body 2 is a discharge tray 23. The recording medium S with a toner image fixed by the fixing unit provided in the fixing unit 21 is discharged to the discharge tray 23.

2. Image Forming Operation

Next, the image forming operation is described using a case of forming a full color image as an example.

Each of the photosensitive drums 4 of the first to fourth process cartridges PY, PM, PC, and PK is rotated in an arrow D direction in FIG. 2 at a predetermined speed (circumferential speed). Further, the intermediate transfer belt 12 is rotated at a speed corresponding to the speed of the photosensitive drum 4 so that the moving direction of intermediate transfer belt 12 at the contact portion with the photosensitive drum 4 becomes forward direction with respect to the moving direction of the photosensitive drum 4 (arrow C direction in FIG. 1).

Further, the laser scanner unit LB is driven. In synchronization with the driving of the laser scanner unit LB, in the first to fourth process cartridges PY, PM, PC, and PK, the surface of the photosensitive drum 4 is uniformly charged by a charging roller 5 in a predetermined polarity and potential. Then, the surface of the photosensitive drum 4 is subjected to scanning and exposure of the laser beam L of the laser scanner unit LB according to an image signal of each color. With this operation, an electrostatic image (electrostatic latent image or latent image) is formed on the surface of each photosensitive drum according to an image signal of each color. The electrostatic image formed on the photosensitive drum 4 is developed by the developing roller 6 that is rotated at a predetermined speed. The developing roller 6 can bear developer on its surface, and can form a developer image (toner image) corresponding to the electrostatic image on the surface of the photosensitive drum 4 by supplying developer to the photosensitive drum 4. In the present exemplary embodiment, the developing roller 6 contacts the photosensitive drum 4, and is rotated so that the moving direction of developing roller 6 at the contact portion with the photosensitive drum 4 becomes forward direction with respect to the moving direction of the photosensitive drum 4 (arrow E direction in FIG. 2).

Through the above-described electrophotographic image forming process operation, on the photosensitive drum 4 of the first process cartridge PY, a yellow toner image corresponding to a yellow component of a full color image is formed. Then, the toner image is primary transferred onto the intermediate transfer belt 12. Similarly, on the photosensitive drum 4 of the second process cartridge PM, a magenta toner image corresponding to a magenta component of the full color image is formed. Then, the toner image is superimposed on the yellow toner image which has been already primary transferred on the intermediate transfer belt 12. Similarly, on the photosensitive drum 4 of the third process cartridge PC, a cyan color toner image corresponding to a cyan component of the full color image is formed. Then, the toner image is primary transferred to superimpose on the yellow and magenta toner images which have been already transferred on the intermediate transfer belt 12. Similarly, on the photosensitive drum 4 of the fourth cartridge PK, a black toner image is formed corresponding to a black component of the full color image. Then, the toner image is primary transferred to superimpose on the yellow, magenta, and cyan toner images which have been already transferred on the intermediate transfer belt 12. In this way, a full color (i.e., four colors) unfixed toner image of yellow, magenta, cyan, and black is formed on the intermediate transfer belt 12.

On the other hand, in the feeding unit 18, a recording medium S is separated and fed one by one at a predetermined control timing. The recording medium S is introduced to the secondary transfer portion N2, which is a contact portion of the secondary transfer roller 17 and the intermediate transfer belt 12 at a predetermined control timing. Through this operation, in the process of the recording medium S being conveyed to the secondary transfer portion N2, the toner image with the four color images superimposed on the intermediate transfer belt 12 is collectively and sequentially secondary transferred on the surface of the recording medium S.

3. Configuration of Process Cartridge

Figure 3:
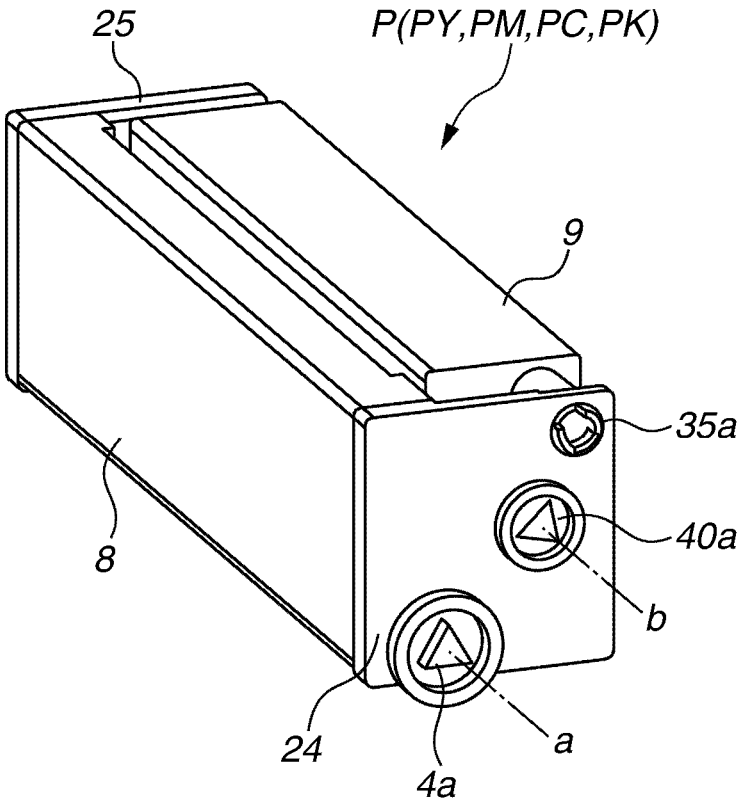
FIG. 3 is an external perspective view schematically illustrating the process cartridge.

As illustrated in FIG. 3, the process cartridge P is horizontally long with a rotation axis "a" direction of the photosensitive drum 4 as a longitudinal direction. In addition, the process cartridge P includes the cleaning unit 8, the developing unit 9, a driving side cover member 24, and a non-driving side cover member 25.

As illustrated in FIG. 2, the cleaning unit 8 includes the photosensitive drum 4, the charging roller 5, a cleaning container 26 to which the cleaning blade 7 is attached.

The photosensitive drum 4 is rotatably supported by the driving side cover member 24 and the non-driving side cover member 25 at both end portions in the rotation axis direction thereof. Further, a drum drive output unit (output side coupling) 51 illustrated in FIG. 7 of the apparatus main body 2 side engages with a drum drive coupling 4*a* of the process cartridge P side. Through this engagement, a drive force is transmitted from a drum drive motor M1 illustrated in FIG. 7 to the photosensitive drum 4. The drum drive motor M1 is a first drive source of the apparatus main body 2. With this configuration, the photosensitive drum 4 is rotated at a predetermined speed in an arrow D direction illustrated in FIG. 2.

The charging roller 5 is rotatably supported by charging roller bearings 27 of the cleaning container 26 at both end portions in the rotation axis direction thereof. The charging roller 5 contacts the surface of the photosensitive drum 4 to be rotated according to the rotation of the photosensitive drum 4. Further, the charging bias is supplied to the charging roller 5 from a charging bias power source (not illustrated) serving as a charging voltage apply unit of the apparatus main body 2. Thus, the surface of the photosensitive drum 4 is charged. At that time, in order to charge the surface of the photosensitive drum 4 uniformly, both end portions of the charging roller 5 in the rotation axis direction thereof is pressurized by a pressurizing spring 28 against the surface of the photosensitive drum 4.

The cleaning blade 7 serving as a cleaning unit is fixed to the cleaning container 26, and the elastic rubber portion of the end portion (free end portion) thereof is brought into contact with the peripheral surface of the photosensitive drum 4. In the present exemplary embodiment, the elastic rubber portion thereof is brought into contact with the photosensitive drum 4 in the counter direction of the rotational direction of the photosensitive drum 4 (arrow D direction illustrated in FIG. 2). In other words, the cleaning blade 7 is brought into contact with the photosensitive drum 4 in such a manner that the end portion thereof is directed to the upstream side of the rotational direction of the photosensitive drum 4. During image formation, the cleaning blade 7 scrapes off the transfer residual toner remaining on the rotating photosensitive drum 4 to clean the surface of the photosensitive drum 4. The transfer residual toner scraped off by the cleaning blade 7 from the surface the photosensitive drum 4 is stored in a waste toner container (waste developer container) 26*a* formed in the cleaning container 26, as waste toner. A cleaning device 70 is configured including the cleaning blade 7 and the waste toner container 26*a*.

4. Configuration of Developing Unit

Figure 4:
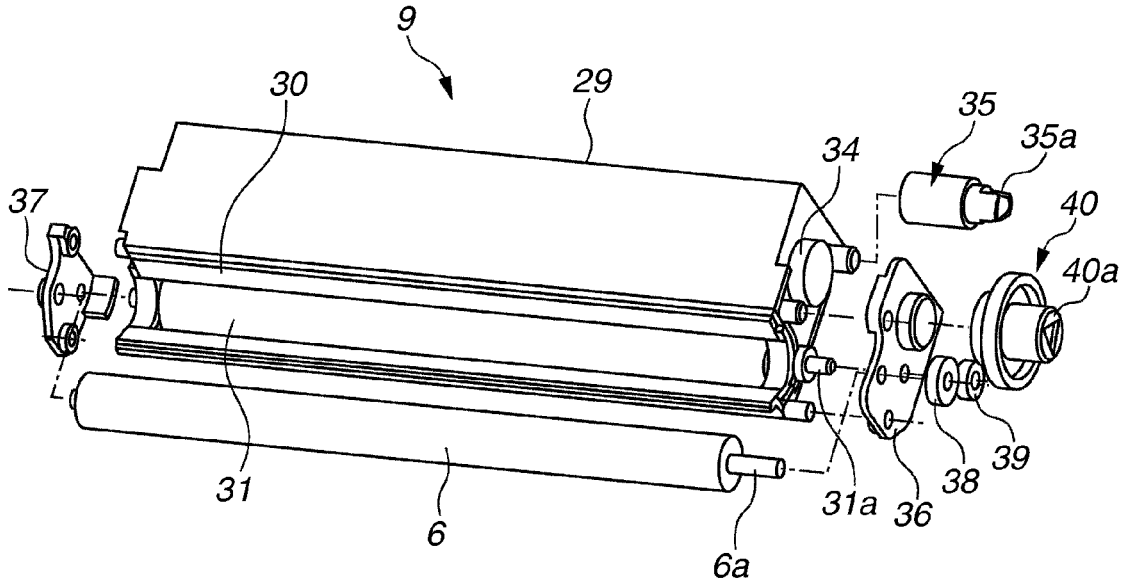
FIG. 4 is an exploded perspective view illustrating a developing unit of the process cartridge.
Figure 5:
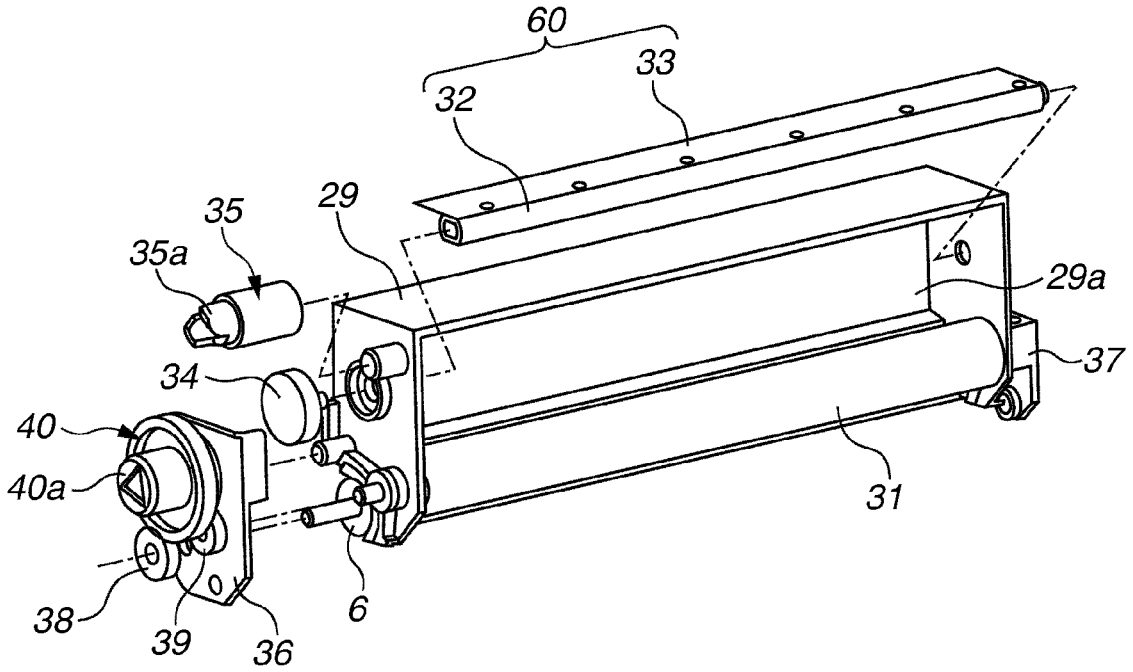
FIG. 5 is an exploded perspective view illustrating the developing unit of the process cartridge.

As illustrated in FIGS. 4 and 5, the developing unit (developing device) 9 has a horizontally long shape with the rotation axis direction of the developing roller 6 as a longitudinal direction. The developing unit 9 includes, other than the developing roller 6, the developer container 29, a developing blade 30, a supply roller 31, an agitation shaft 32, an agitation sheet 33, an agitation shaft gear 34, and an agitation drive gear 35. Further, the developing unit 9 includes a driving side bearing 36, a non-driving side bearing 37, a developing roller gear 38, a supply roller gear 39, and a developing drive input gear 40.

The developing roller 6, which is a developer bearing member serving as a developing unit, and a supply roller 31 serving as a developer supply member are arranged in the opening of the developer container 29. Both end portions in the rotation axis direction of the developing roller 6 and the supply roller 31 are rotatably supported with the driving side bearing 36 and the non-driving side bearing 37, respectively attached to both side surfaces of the developer container 29. In the present exemplary embodiment, the rotation axis direction of the developing roller 6 and the rotation axis direction of the supply roller 31 are substantially in parallel. Further, in the present exemplary embodiment, the rotation axis directions of the developing roller 6 and the supply roller 31 are substantially parallel with the rotation axis direction of the photosensitive drum 4. Further, at the driving side end portions of a core member 6*a* of the developing roller 6 and a core member 31*a* of the supply roller 31, the developing roller gear 38 and the supply roller gear 39 are respectively fixed. These developing roller gear 38 and the supply roller gear 39 are engaged with the developing drive input gear 40.

The developing drive input gear 40 includes a developing drive coupling 40*a*, which engages with a developing drive output unit (output side coupling) 52 (FIG. 7) of the apparatus main body 2. With this configuration, a drive force is transmitted from a developing drive motor M2 in FIG. 7, which is a second drive source of the apparatus main body 2. In this way, the developing roller 6 and the supply roller 31 are rotated respectively at a predetermined speed. Then, the supply roller 31 rotates while contacting the developing roller 6, and the toner stored in a toner container (developer container) 29*a* formed in the developer container 29 is borne on the developing roller 6.

In the present exemplary embodiment, the developing roller 6 and the supply roller 31 are rotated so that the moving directions thereof become opposite to each other at each contact portion (arrows E and F directions in FIG. 2). In the present exemplary embodiment, in a state where the process cartridge P is mounted on the apparatus main body 2, at the contact portion of the developing roller 6 and the supply roller 31, the developing roller 6 moves upward from the downside and the supply roller 31 moves downward from the upper side. A toner supply position T is provided at the upstream end portion (the downstream end portion of the developing roller 6 in the moving direction) of the supply roller 31 in the moving direction at the contact portion of the developing roller 6 and the supply roller 31. The toner supply position T extends along the rotation axis directions of the developing roller 6 and the supply roller 31.

The developing blade 30 as a developer regulation member is fixed to the developer container 29, and the end portion (free end portion) thereof is brought into contact with the peripheral surface of the developing roller 6. In the present exemplary embodiment, the developing blade 30 is brought into contact with the peripheral surface of the developing roller 6 in a counter direction of the rotational direction (arrow E direction in FIG. 2) of the developing roller 6. In other words, the developing blade 30 is brought into contact with the peripheral surface of the developing roller 6 in such a manner that the end portion thereof is directed to the upstream side of the rotational direction of the developing roller 6. The developing blade 30 regulates the thickness of the toner layer formed on the peripheral surface of the developing roller 6, and provides charge to toner. The charge is generated by the frictional electrification caused by the contact pressure between the developing roller 6 and the developing blade 30.

The developing unit 9 is constantly urged by a pressurizing spring (not illustrated) serving as an urging means to a direction (arrow G direction in FIG. 2) in which the developing roller 6 is brought into contact with the photosensitive drum 4 around the swing center (axis b) illustrated in FIG. 2. In this way, the developing roller 6 is brought into contact with the photosensitive drum 4.

During image formation, the supply roller 31 and the developing roller 6 are rotated while contacting and pressing each other, toner in the toner container 29*a* of the developer container 29 is borne on the developing roller 6. The developing blade 30 forms a toner layer of a predetermined layer thickness on the peripheral surface of the developing roller 6, and also provides charge generated by the frictional electrification to toner. Then, at the contact portion (developing portion) of the developing roller 6 and the photosensitive drum 4, the charged toner on the developing roller 6 adheres to the electrostatic image formed on the photosensitive drum 4 to develop the electrostatic image as a toner image.

The agitation shaft 32, the agitation sheet 33, the agitation shaft gear 34, and the agitation drive gear 35 in the developing unit 9 will be described in detail below.

5. Configuration of Agitation Member

As illustrated in FIG. 5, in the toner container 29*a* of the developer container 29, an agitation blade 60 serving as an agitation member is provided. The agitation blade 60 includes the agitation shaft 32 serving as a rotation shaft member and the agitation sheet 33 serving as a agitation unit. The agitation shaft 32 is disposed along the longitudinal direction of the developing unit 9 which is substantially parallel to the rotation axis direction of the developing roller 6. The agitation sheet 33 is a sheet member with flexibility having substantially a rectangular shape with longer sides in one direction, and one end portion of the agitation sheet 33 in the widthwise direction is fixed to the agitation shaft 32 along the longitudinal direction thereof. Further, both end portions of the agitation shaft 32 in the rotation axis direction are rotatably supported respectively by the bearings of the side surface of the developer container 29. At the driving side end portion of the agitation shaft 32, the agitation shaft gear 34 is fixed. In this way, the agitation shaft 32, the agitation sheet 33, and the agitation shaft gear 34 are integrally provided to the developer container 29 in a rotatable manner.

At the driving side surface of the developer container 29, the agitation drive gear 35 is rotatably supported and engaged with the agitation shaft gear 34. The agitation drive gear 35 is provided with an agitation drive coupling 35*a*, which engages with the agitation drive output unit (output side coupling) 53 (FIG. 7) of the apparatus main body 2. With this configuration, a drive force is transmitted from an agitation drive motor M3 in FIG. 7, which is a third drive source of the apparatus main body 2. The rotation of the agitation drive gear 35 causes the agitation blade 60 serving as an agitation member including the agitation shaft 32 and the agitation sheet 33 to rotate in the arrow H direction in FIG. 2, together with the agitation drive gear 34, and to agitate toner in the toner container 29*a* of the developer container 29.

In this way, toner is agitated to accelerate circulation of the toner in the vertical direction. Thus, the deviation of the toner amount in a longitudinal direction is improved. Accordingly, the toner state supplied to the developing roller 6 and the supply roller 31 can be uniform, and thus stable image forming can be achieved.

In addition, in the present exemplary embodiment, in a state where the process cartridge P is mounted on the apparatus main body 2, the toner container 29*a* is disposed above the developing roller 6 in the vertical direction. More specifically, in a state where the process cartridge P is mounted on the apparatus main body 2, the toner container 29*a* is disposed above the toner supply position T to the developing roller 6 in the vertical direction. As described above, in the present exemplary embodiment, the toner supply position T is disposed at the upstream end portion of the moving direction of the supply roller 31 (at the downstream end portion of the developing roller 6 in the moving direction thereof), at the contact portion of the developing roller 6 and the supply roller 31. Therefore, without agitation by the agitation sheet 33, toner is supplied to the toner supply position T due to the weight of itself. However, the agitation by the agitation sheet 33 is necessary to unstiffen the packed toner which has been hardened during the stoppage of the developing unit 9, and to improve the deviation of the toner amount in the longitudinal direction of the developing unit 9.

6. Operation of Agitation Blade

Next, the operation of the agitation blade 60 will be described.

In the present exemplary embodiment, the agitation blade 60 is generally rotated when the developing roller 6 and the photosensitive drum 4 are not rotated. On the other hand, the agitation blade 60 is not rotated when the developing roller 6 and the photosensitive drum 4 are rotated.

Figure 7:
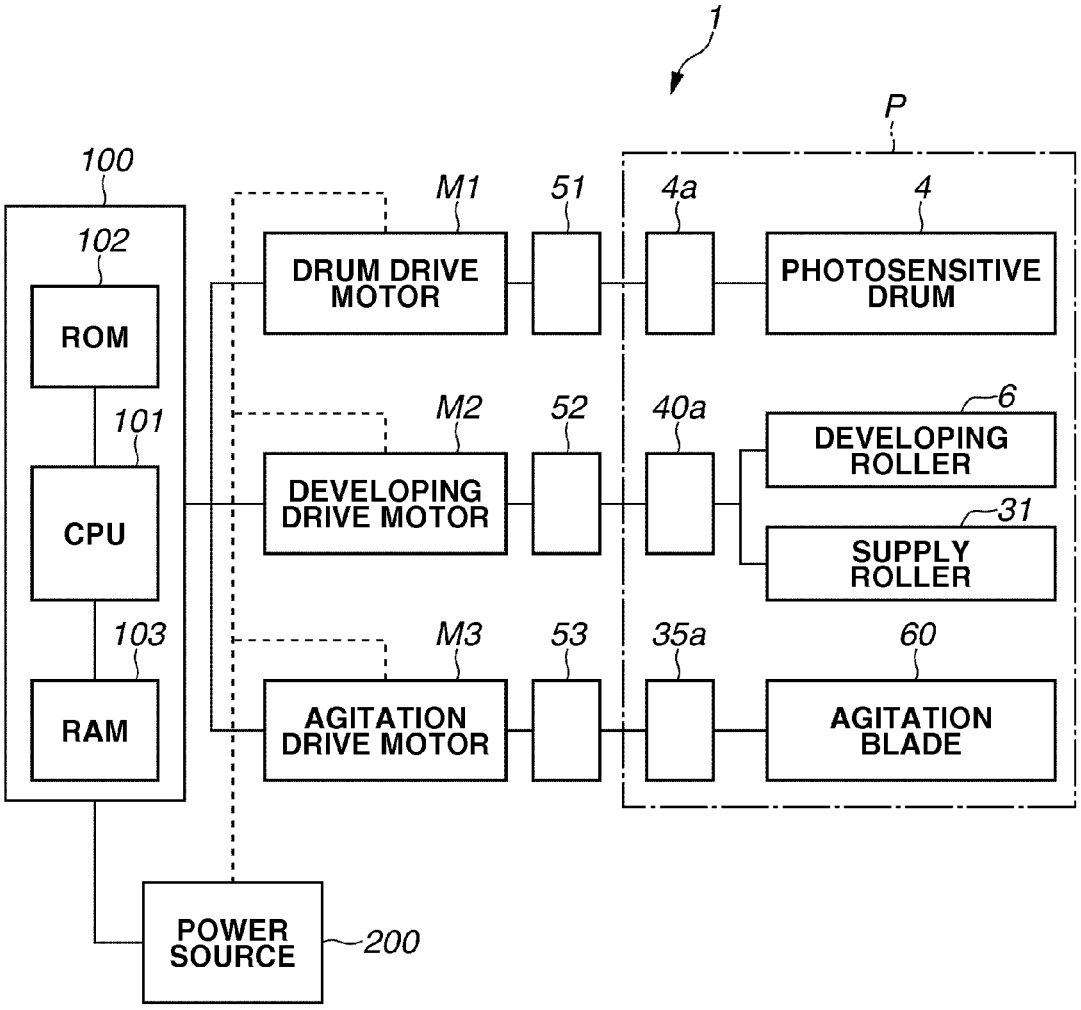
FIG. 7 is a control block diagram schematically illustrating main part of an image forming apparatus.

Herein, the control method according to the present exemplary embodiment will be described. FIG. 7 is a control block diagram schematically illustrating main part relating to an operation sequence for controlling the agitation blade 60 of the image forming apparatus 1 according to the present exemplary embodiment. In the present exemplary embodiment, the operation of each component of the image forming apparatus 1 is integrally controlled by a control unit 100 provided in the apparatus main body 2. The control unit 100 includes a CPU 101, memories such as a read only memory (ROM) 102 and a random access memory (RAM) 103 as a storage unit (storage device). The CPU 101 is a main element for performing arithmetic processing. The RAM 103 is a rewritable memory to store information input to the control unit 100, detected information, and calculation results, and the ROM 102 stores control programs and data tables obtained in advance. The CPU 101 can transfer and read data to/from the ROM 102 and the RAM 103.

The CPU 101 performs control of the image formation operation sequence according to the control programs stored in the ROM 102, and also performs control of the operation sequence of the agitation blade 60. The control of the operation sequence of the agitation blade 60 will be described below in more detail. According to the present exemplary embodiment, the CPU 101 controls drive/stop and the driving speed of each of the drum drive motor M1, the developing drive motor M2, and the agitation drive motor M3.

As described above, the drive force from the drum drive motor M1 is transmitted to the photosensitive drum 4 by connecting the drum drive output unit 51 (i.e., drive output unit of the apparatus main body 2 side) and the drum drive coupling 4*a* (i.e., drive input unit of the process cartridge P side). Further, the drive force from the developing drive motor M2 is transmitted to the developing drive input gear 40 by connecting the developing drive output unit 52 (i.e., the drive output unit of the apparatus main body 2 side) and the developing drive coupling 40*a* (i.e., the drive input unit of the process cartridge P side). The drive force is transmitted to the developing roller 6 and the supply roller 31 via the developing roller gear 38 and the supply roller gear 39 (see FIGS. 4 and 5). Further, the drive force from agitation drive motor M3 is transmitted to the agitation drive gear 35 by connecting agitation drive output unit 53 (i.e., the drive output unit of the apparatus main body 2 side) and the agitation drive coupling 35*a* (i.e., the drive input unit of the process cartridge P side). Then, the drive force is transmitted to the agitation blade 60 via the agitation shaft gear 34 (see FIGS. 4 and 5). Power is supplied from a common power source 200 to the drum drive motor M1, the developing drive motor M2, and the agitation drive motor M3.

Next, the operation sequences during the image formation and the toner agitation will be described.

Figure 6A:
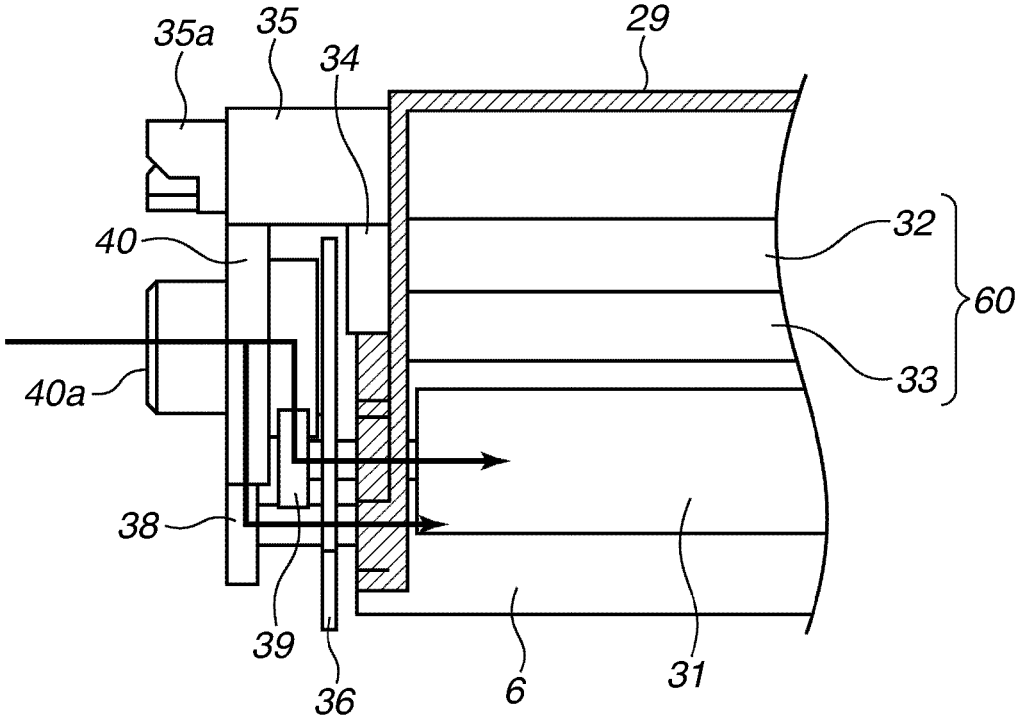
FIGS. 6A and 6B are side views of main part each illustrating an example of driving configurations of a developer bearing member and an agitation member.

In the present exemplary embodiment, during image formation, the photosensitive drum 4 and the developing drive input gear 40 are rotated by the drive force obtained from the drum drive motor M1 and the developing drive motor M2 of the apparatus main body 2. At that time, as illustrated in FIG. 6A, in the developing unit 9, the drive force is transmitted to the developing roller 6 and the supply roller 31 from the developing drive input gear 40 respectively via the developing roller gear 38 and the supply roller gear 39. At that time, the agitation drive motor M3 is stopped, and the drive force is not transmitted to the agitation input gear 35. Accordingly, the agitation blade 60 is stopped.

As a result, the rotation speeds of the photosensitive drum 4 and the developing roller 6 are not varied caused by the drive torque of the agitation blade 60. Therefore, even if a power source that cannot supply large power is used for the image forming apparatus 1, stable image formation can be performed without density unevenness and pitch unevenness.

Figure 6B:
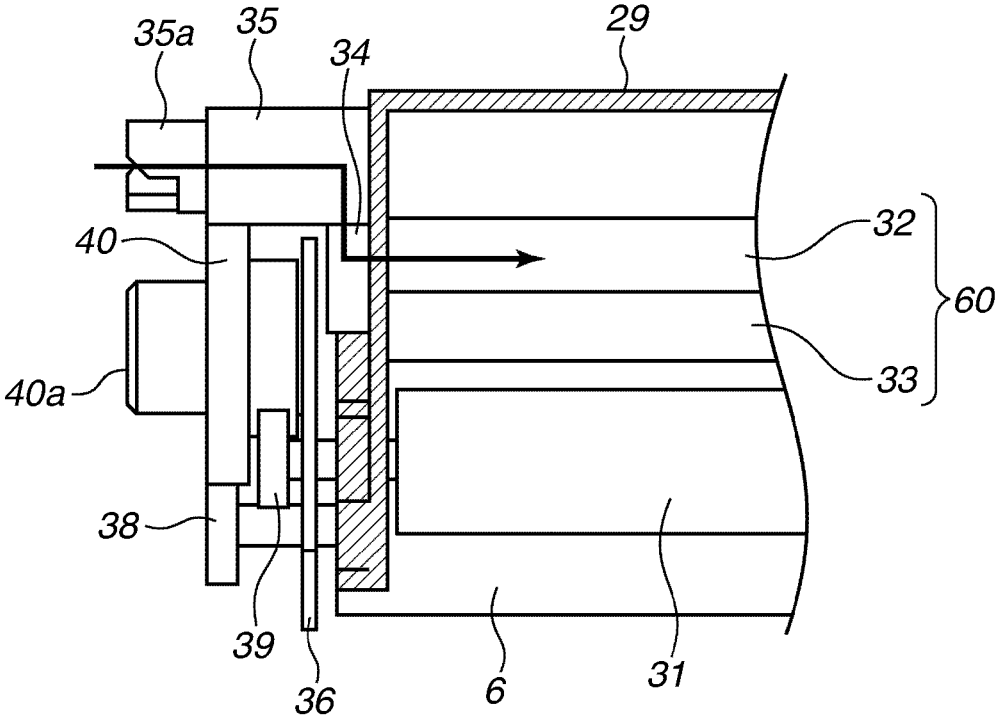

On the other hand, when toner in the toner container 29*a* of the developer container 29 is agitated, the agitation drive gear 35 is rotated by obtaining the drive force from the agitation drive motor M3 of the apparatus main body 2. At that time, as illustrated in FIG. 6B, in the developing unit 9, the drive force is transmitted to the agitation shaft 32 from the agitation drive gear 35 via the agitation shaft gear 34. At that time, the drum drive motor M1 and the developing drive motor M2 are stopped, and the drive force is not transmitted to the photosensitive drum 4 and the developing drive input gear 40. As a result, the photosensitive drum 4, the developing roller 6, and the supply roller 31 are stopped.

In the present exemplary embodiment, toner in the toner container 29*a* is agitated by the agitation blade 60 during non-image formation period. Examples of the non-image formation period include following periods. One of the examples is a predetermined period of a pre-frequent rotation process in which a predetermined preparation operation is performed at the time of power-on of the image forming apparatus or return from the sleep mode. Further, another example is a predetermined period of a pre-rotation process in which a predetermined preparation operation is performed from when the image formation signal is input until the image corresponding to the image information is actually read out. Further, another example is a predetermined period of a post-rotation process in which a predetermined arrangement operation (preparation operation) is performed after the image formation is completed. In all of or part of the above described examples, the agitation blade 60 can perform agitation of toner in the toner container 29*a*. However, as described above, during the agitation of toner in the toner container 29*a* by the agitation blade 60, the rotation of the photosensitive drum 4, the developing roller 6, and the supply roller 31 is stopped. Further, in the present exemplary embodiment, the intermediate transfer belt 12 is rotated and stopped according to ON/OFF of the drive force from the intermediate transfer member drive motor (not illustrated) substantially in synchronization with rotation and stop of the photosensitive drum 4. In the present exemplary embodiment, the agitation blade 60 agitates toner in the toner container 29*a* during a predetermined period of the post-rotation process (i.e., a predetermined period after the photosensitive drum 1 or the like is stopped).

Figure 8:
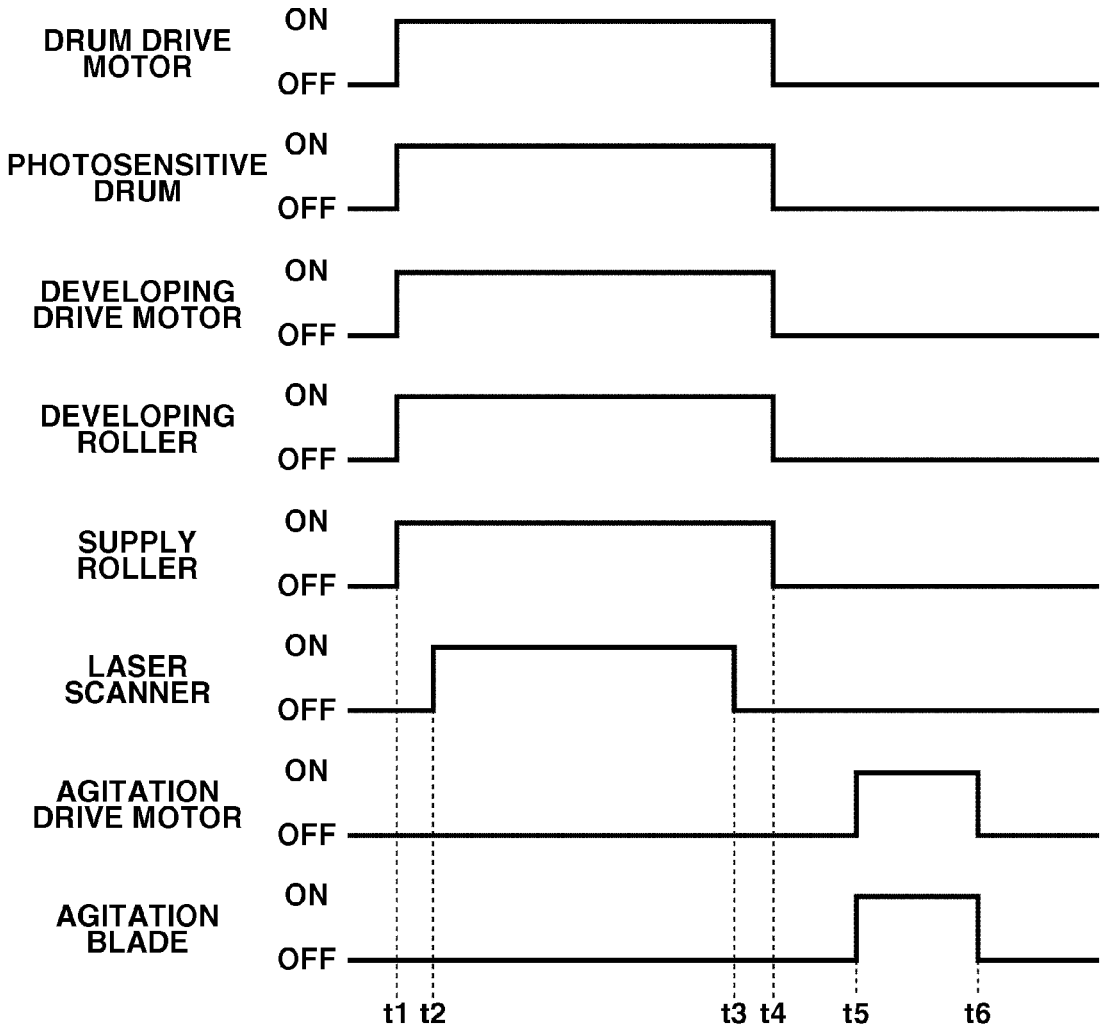
FIG. 8 is a timing chart illustrating an operation sequence of an agitation blade.

FIG. 8 is a timing chart schematically illustrating operation timing of the agitation blade according to the present exemplary embodiment. In the timing chart illustrated in FIG. 8, to facilitate understanding, operation timings of many other components relating to the image forming operation are not illustrated. The CPU 101 of the control unit 100 controls each part of the image forming apparatus 1 according to the sequence illustrated in FIG. 8.

When the image forming signal (i.e., image formation start instruction) is input to the image forming apparatus 1, the CPU 101 starts driving the drum drive motor M1, and starts rotating the photosensitive drum 4 (t1). At substantially the same timing, the CPU 101 starts driving the developing drive motor M2, and starts rotating the developing roller 6 and the supply roller 31 (t1). Then, the laser scanner unit LB starts to form an electrostatic image (t2). After the laser scanner unit LB finishes forming the electrostatic image (t3), each step of developing, transferring (primary transfer and secondary transfer) (not illustrated), the CPU 101 stops the drum drive motor M1 and the developing drive motor M2. With this operation, the photosensitive drum 4, the developing roller 6, and the supply roller 31 stops to be rotated (t4). Thereafter, the CPU 101 starts driving the agitation drive motor M3, starts rotating the agitation blade 60 (t5), and during a predetermined period, toner in the toner container 29*a* is agitated. The predetermined period is set in advance according to the number of rotations and the time of rotations of the agitation blade 60, as an enough period for loosening toner or correcting the deviation of toner as described above. Then, the CPU 101 stops the agitation drive motor M3, and stops rotating the agitation blade 60 (t6). Thus, the job (a series of image forming operations for one or more recording media by one image forming start instruction) is completed.

Through such a sequence, the developing drive motor M2 for driving the developing roller 6 as a process unit, and the agitation drive motor M3 for driving the agitation blade 60 as an agitation member can be driven at different timings. Further, in the present exemplary embodiment, through the above described sequence, the drum drive motor M1 for driving the photosensitive drum 1, and the agitation drive motor M3 for driving the agitation blade 60 as an agitation member can be driven at different timings. Further, in the present exemplary embodiment, during the driving of the agitation drive motor M3, all the motors for driving the rotation members in the intermediate transfer belt unit 11, the feeding unit 18, and the fixing unit 21, are stopped. Therefore, the output power of the power source 200 of the apparatus main body 2 can be restrained. The power source 200 is used for driving the developing drive motor M2, the agitation drive motor M3, the drum drive motor M1, and drive motors for driving other rotation members.

As a result, power consumption of the image forming apparatus 1 can be restrained, and increase in cost can be restrained, which is caused by using a large output power source. Further, since the operation can be achieved with a simple and easy sequence of switching the driving of motors, it does not bring about an increase in cost due to increase of sensors and actuators.

As described above, the image forming apparatus 1 according to the present exemplary embodiment includes the developer container (toner container 29*a*) configured to store developer (toner) and the image bearing member (photosensitive drum 4) configured to be rotated and on which a latent image is formed, the developer bearing member (developing roller 6) configured to bear developer and to be rotated to develop the latent image. In addition, the agitation member (agitation blade 60) configured to be rotated to agitate the developer stored in the developer container (toner container 29*a*) In addition, the image forming apparatus 1 includes the control unit 100 configured to control the rotations of the image bearing member (photosensitive drum 4), the developer bearing member (developing roller 6), and the agitation member (agitation blade 60) so as to rotate the agitation member while the image bearing member is not rotated.

As described above, according to the present exemplary embodiment, without increase in cost and power consumption of the power source, stable image formation can be achieved without influence of the drive load variation of the agitation blade 60.

Next, a second exemplary embodiment of the present invention will be described. The basic configuration and the operation of the image forming apparatus according to the present exemplary embodiment are similar to those of the first exemplary embodiment. Therefore, components having the same or corresponding functions or configurations of the first exemplary embodiment are denoted the same symbols, and detailed descriptions thereof are omitted.

In the first exemplary embodiment, the agitation blade 60 agitates toner in the toner container 29*a* after the image formation is completed.

In the present exemplary embodiment, when the image formation is repeatedly performed for a long time, a sequence is provided for driving the agitation blade 60 for a predetermined time period between the image formation operations according to the number of image formed sheets and the operation time (image formation time). Through this operation, the image defect caused by toner supply shortage can be prevented from being generated. The agitation blade 60 is driven during the image formation on a recording medium S and the next recording medium S, in continuous image formation.

At that time, in the present exemplary embodiment, similar to the first exemplary embodiment, in the developing unit 9, toner is stored above the developing roller 6 and the supply roller 31. With this configuration, the weight of toner itself can be used for supplying toner to the developing roller 6 and the supply roller 31. Therefore, even when the image formation is repeated for a long time, since the supply shortage of toner rarely occurs, the driving time of the agitation blade 60 can be minimized. As a result, the power consumption due to the drive of the agitation blade 60 can be reduced. Further, the deterioration of the repetition speed of image formation can be prevented.

Figure 9:
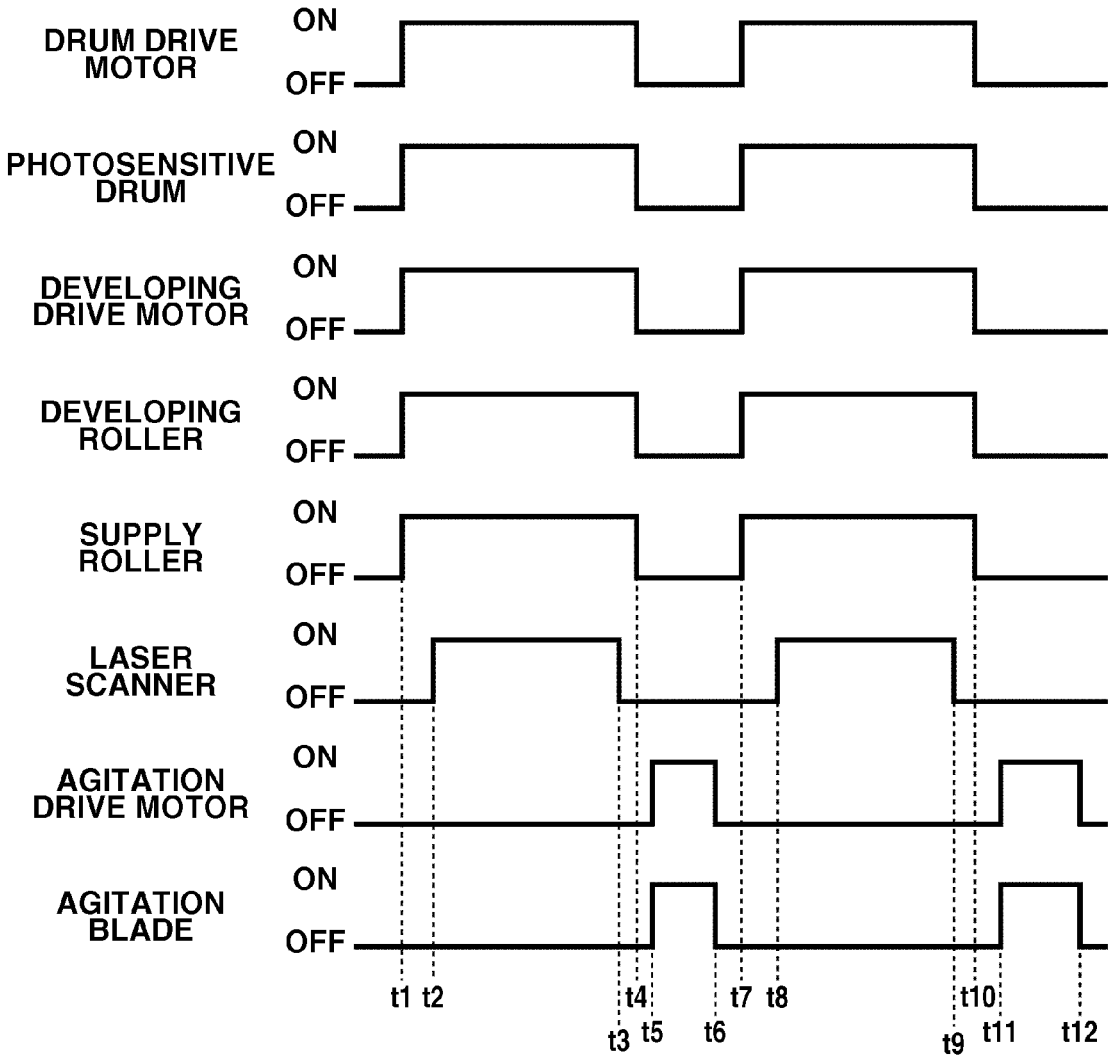
FIG. 9 is a timing chart illustrating an operation sequence of the agitation blade.

FIG. 9 is a timing chart schematically illustrating the operation timing of the agitation blade according to the present exemplary embodiment. In the timing chart of FIG. 9, to facilitate understanding, operation timings of many other components relating to the image forming operation are not illustrated. The CPU 101 of the control unit 100 controls each part of the image forming apparatus 1 according to the sequence illustrated in FIG. 9.

When the image forming signal (i.e., image formation start instruction) is input to the image forming apparatus 1, the CPU 101 starts to drive the drum drive motor M1, and rotate the photosensitive drum 4 (t1). At substantially the same timing, the CPU 101 starts to drive the developing drive motor M2, and rotate the developing roller 6 and the supply roller 31 (t1). Then, the laser scanner unit LB starts to form an electrostatic image (t2). After the laser scanner unit LB finishes forming the electrostatic image (t3), and each step of developing, transferring (primary transfer and secondary transfer) (not illustrated), the CPU 101 stops the drum drive motor M1 and the developing drive motor M2. Through this operation, the photosensitive drum 4, the developing roller 6, and the supply roller 31 are caused to stop rotating (t4). Then, the CPU 101 starts to drive the agitation drive motor M3, rotate the agitation blade 60 (t5), and during a predetermined period, toner in the toner container 29*a* is agitated. The predetermined period is set in advance according to the number of rotations and the time of rotations of the agitation blade 60, as a enough period for loosening toner or correcting the deviation of toner as described above. Then, the CPU 101 stops the agitation drive motor M3, and accordingly the agitation blade 60 stops to rotate (t6). Then, the CPU 101 restarts the driving of the drum drive motor M1, rotation of the photosensitive drum 4, and also driving of the developing drive motor M2, and rotation of the developing roller 6 and the supply roller 31 (t7). Then, the laser scanner unit LB restarts the formation of the electrostatic image (t8).

More specifically, when the number of the sheets of image formation or the image formation time of the job is larger than a predetermined number of sheets of image formation or longer than a predetermined image formation time, the CPU 101 performs the following control. Specifically, for each predetermined number of sheets of image formation or each predetermined image formation time, the CPU 101 repeats to drive the agitation blade 60 for a predetermined time (t9, t10, t11, and t12). Then, the job (a series of image forming operations for one or more recording media by one image forming start instruction) is completed.

As described above, for each predetermined number of sheets of image formation or each operation time (predetermined image formation time, the CPU 101 drives the agitation blade 60 for a predetermined time. However, the sequence for driving the agitation blade 60 for a predetermined time according to the number of sheets of image formation or the operation time (image formation time) is not limited thereto. For example, as the number of sheets of image formation or the image formation time is increased, the frequency of driving the agitation blade 60 may be increased, or the predetermined time for driving the agitation blade 60 may be longer.

In this way, in the present exemplary embodiment, the control unit once halts the image forming operation during the continuous image forming operation on a plurality of recording media, and performs operation of driving agitation member for a predetermined time.

As described above, according to the present exemplary embodiment, even when image formation is repeated for a long time, since the supply shortage of toner rarely occurs, and the similar effect to that of the first exemplary embodiment can be obtained.

The exemplary embodiment of the present invention has been described above. However, the present invention is not limited thereto.

Figure 10A:
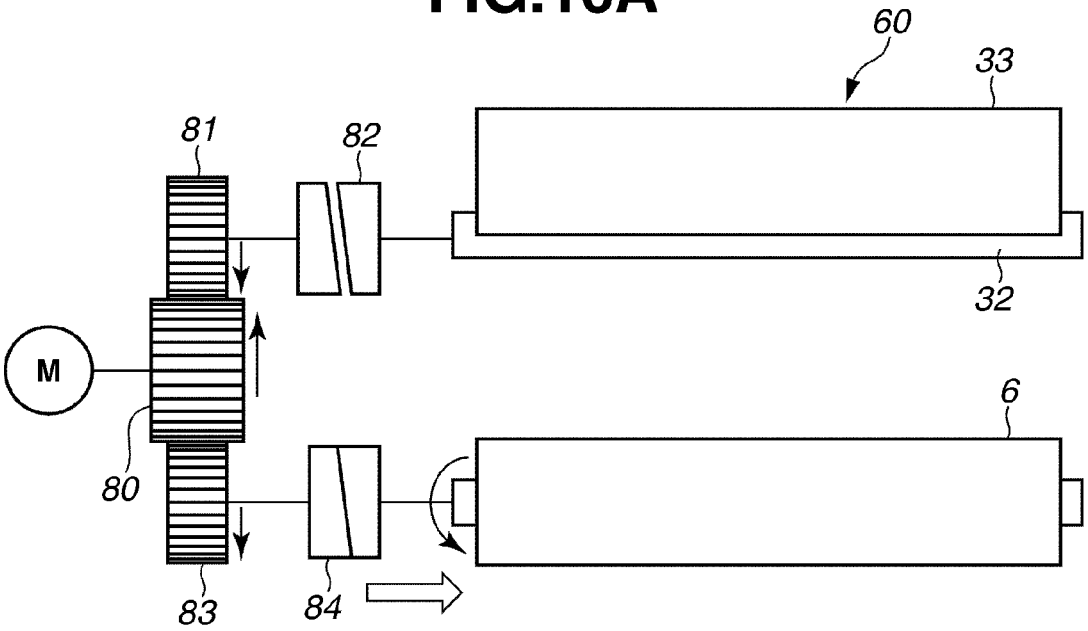
FIGS. 10A and 10B are schematic diagrams each illustrating an example of driving configurations of a developer bearing member and an agitation member.
Figure 10B:
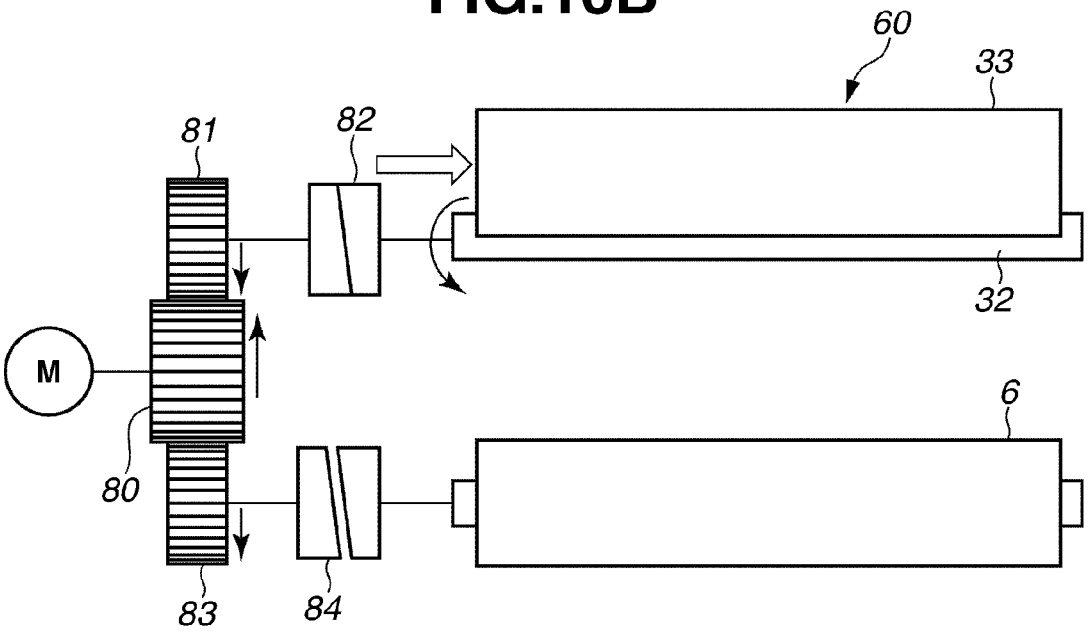

For example, in the exemplary embodiments described above, the drum drive motor M1, the developing drive motor M2, and the agitation drive motor M3 are separately provided. However, for example, with a configuration in which the driving force from one motor of the apparatus main body 2 may be switched to each of driving output units of the photosensitive drum 4, the developing roller 6, and the agitation blade 60. In this case also, the similar effect can be obtained. FIGS. 10A and 10B are schematic diagrams each illustrating an example configuration of transmitting the driving force from a common motor M of the apparatus main body 2 to the developing roller 6 and the agitation blade 60. The drive force is transmitted from the motor M of the apparatus main body 2 to a gear 80. The drive force is transmitted to the agitation blade 60 via a gear 81 and an agitate drive switching unit (clutch) 82. The drive force is also transmitted to the developing roller 6 via a gear 83 and a developing drive switching unit (clutch) 84. For example, between the agitation drive switching unit 82 and the agitation blade 60 and between the developing drive switching unit 84 and the developing roller 6, the drive output unit (not illustrated) of the apparatus main body 2 side and the drive input unit (not illustrated) of the process cartridge P side are respectively disposed.

Then, during image formation, as illustrated in FIG. 10A, the agitation drive switching unit 82 is switched in a non-connection state to stop the rotation of the agitation blade 60. The developing drive switching unit 84 is switched in a connection state to drive the developing roller 6 to rotate. When toner in the toner container 29*a* is agitated, as illustrated in FIG. 10B, the agitation blade 60 is brought into a connection state by the agitation drive switching unit 82 and is rotated. The developing roller 6 is brought into a non-connection state by the developing drive switching unit 84 and the rotation thereof is stopped. Similarly, the photosensitive drum 4 may be driven by the common motor M via a drive transmission path capable of connecting/disconnecting the drive force so as to rotate and stop the photosensitive drum 4 in synchronization with the above described developing roller 6. Further, similar to the above-described exemplary embodiment, the supply roller 31 may be driven by the common motor M via a drive transmission path capable of connecting and disconnecting the drive force so as to rotate and stop the photosensitive drum 4 in synchronization with the above described developing roller 6.

In the above-described exemplary embodiments, the drive forces from separate drive sources are transmitted to the photosensitive drum 4 and the developing roller 6, via separate drive input units. However, it is not limited thereto. The electrophotographic photosensitive member and the process unit may be connected for driving, and the drive force from a common drive source may be transmitted via a common drive input unit.

Further, as desired, the agitation member may be driven when at least one of the photosensitive member and the process unit is not driven. With this configuration, depending on the configuration of the image forming apparatus, without increase in cost and power consumption, stable image formation can be performed without influence of variation of the drive load of the agitation member.

Further, in the above-described exemplary embodiments, the process unit rotated and acting on the electrophotographic photosensitive member is the developing roller 6 as a developing unit. However, it is not limited thereto. For example, the process unit may be any process unit as long as it is rotated and can act on an electrophotographic photosensitive member. Such examples include a charging roller as a charging unit that can be rotated and charge the photosensitive drum 4, and a brush roller as a cleaning unit that can be rotated and remove transfer residual toner remaining on the photosensitive drum 4. Further, a plurality of process units can be included.

As described above, the process cartridge may be integrally configured including at least an electrophotographic photosensitive member, a process unit, a developer container, and an agitation member, and may be attachable and detachable to and from the apparatus main body of the electrophotographic image forming apparatus. More specifically, the process cartridge includes a first drive input unit provided separately or commonly for receiving rotation drive forces from the apparatus main body to the electrophotographic photosensitive member and the process unit. Further, the process cartridge includes a second drive input unit for receiving a rotation drive force from the apparatus main body to the agitation member. The agitation member can be rotated when at least one of the electrophotographic photosensitive member and the process unit is not driven. In the above-described exemplary embodiments, the drum drive coupling 4*a* and the developing drive coupling 40*a* configure the first drive input units provided separately. However, as described above, a drive force from a common drive source may be transmitted to the electrophotographic photosensitive member and the process unit via a common drive input unit. Further, in the above-described exemplary embodiments, the agitation drive coupling 35*a* configures the second drive input unit.

Figure 11A:
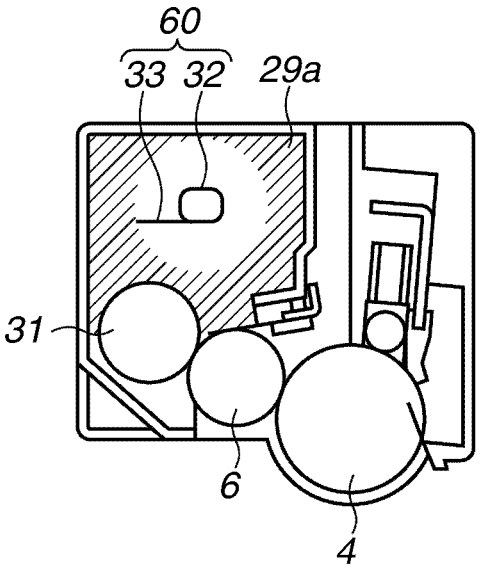
FIG. 11A is a cross-sectional view of a process cartridge of a comparative example.
Figure 11B:
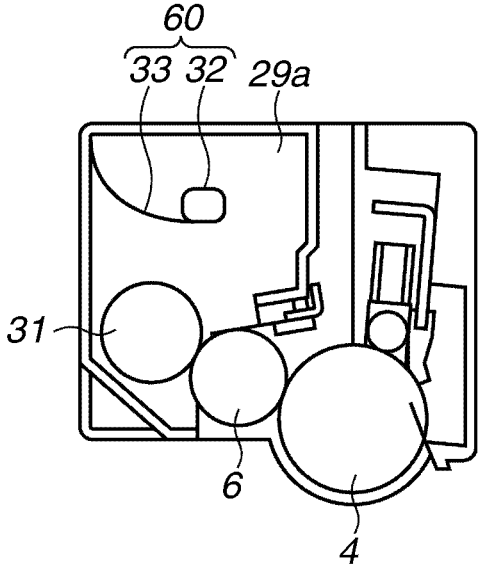
FIGS. 11B, 11C, and 11D are cross-sectional views of a process cartridge according to a third exemplary embodiment.
Figure 11C:
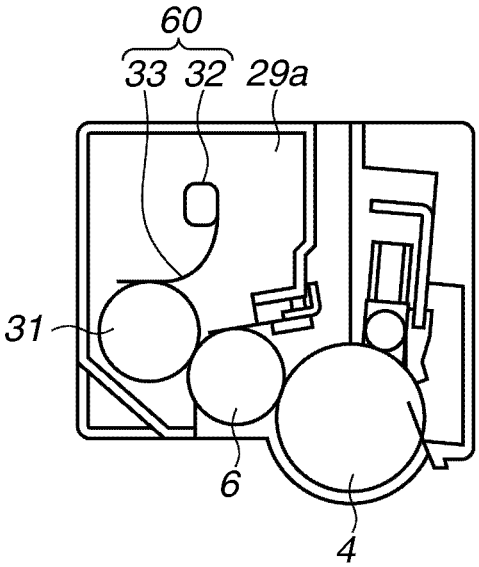
Figure 11D:
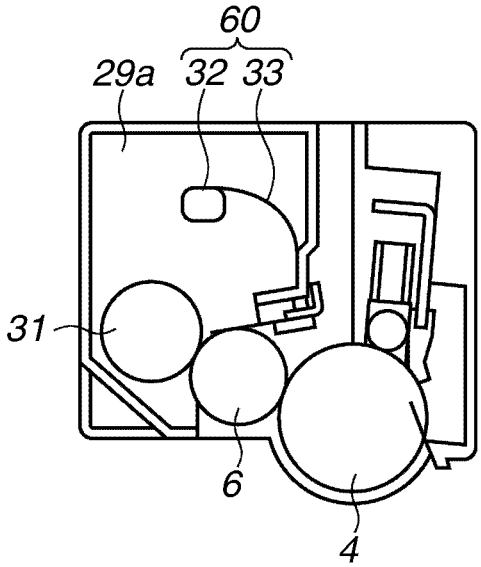

Hereinbelow, a configuration according to a third exemplary embodiment will be described with reference to FIGS. 11A, 11B, 11C, and 11D. FIGS. 11B, 11C, and 11D illustrate the configuration of the present exemplary embodiment, however, FIG. 11A illustrates a comparative example of the present exemplary embodiment. In the following descriptions, members having similar functions to those of the first exemplary embodiment are designated by the same numerals, and the detailed descriptions thereof may be omitted. Configurations different from those of the first exemplary embodiment will be mainly described.

In the present exemplary embodiment, as illustrated in FIGS. 11B, 11C, and 11D, the agitation sheet provided within the toner container 29*a* has enough length to touch the inner wall of the toner container 29*a*, and a supply roller (developer supply member) 31. With this configuration, the agitation sheet 33 can agitate toner existing at the corner of the toner container 29*a*.

FIG. 11A illustrates a configuration, as a comparative example, in which the agitation sheet 33 does not touch the inner wall of the toner container 29*a* (i.e., the agitation sheet 33 is short). This configuration corresponds to the configuration according to the first exemplary embodiment. In a case of the comparative example, when the agitation blade 60 is rotated, regions (hatched area illustrated in FIG. 11A) that are not agitated may exist in the toner container 29*a*. On the other hand, in the present exemplary embodiment (see FIGS. 11B, 11C, and 11D), when the agitation blade 60 is rotated, a wide region can be agitated. Therefore, regions where toner is accumulated are rarely generated in the toner container 29*a*.

However, if the agitation sheet 33 is formed longer, the following issues may occur. Specifically, when the agitation blade 60 is rotated, if the agitation sheet 33 touches the inner wall of the toner container 29*a* or the supply roller 31, the process cartridge P, the photosensitive drum 4, or the developing roller 6 may vibrate caused by the shock of the touch. If the agitation blade 60 is rotated during image formation, the photosensitive drum 4 may vibrate to cause image defect. Further, each time the agitation sheet 33 touches the supply roller 31, toner included in the supply roller 31 may drop from the supply roller 31. As a result, toner may not be supplied to the developing roller 6 sufficiently.

Accordingly, in the present exemplary embodiment, similar to the above-described first exemplary embodiment, the control unit 100 (see FIG. 7) rotates the agitation blade 60 when the photosensitive drum 4 and the developing roller 6 are not rotated. In other words, the control unit 100 rotates the agitation blade 60 while the photosensitive drum 4 and the developing roller 6 are not performing the image formation. Therefore, even when the agitation blade 60 is rotated to cause the photosensitive drum 4 and the developing roller 6 to vibrate or the toner borne by the supply roller 31 to drop, image defect does not occur.

Further, in the present exemplary embodiment, similar to the first and second exemplary embodiments, power consumed when the agitation blade 60 is rotated (power consumption) can be reduced. Further, in the present exemplary embodiment, similar to the above-described exemplary embodiments, when the developing roller 6 is stopped, the supply roller 31 also is stopped. Therefore, when the agitation blade 60 is rotated, there is no rotating member in the process cartridge P. Therefore, the power consumption when the agitation blade 60 is rotated can be further reduced.

Figure 12:
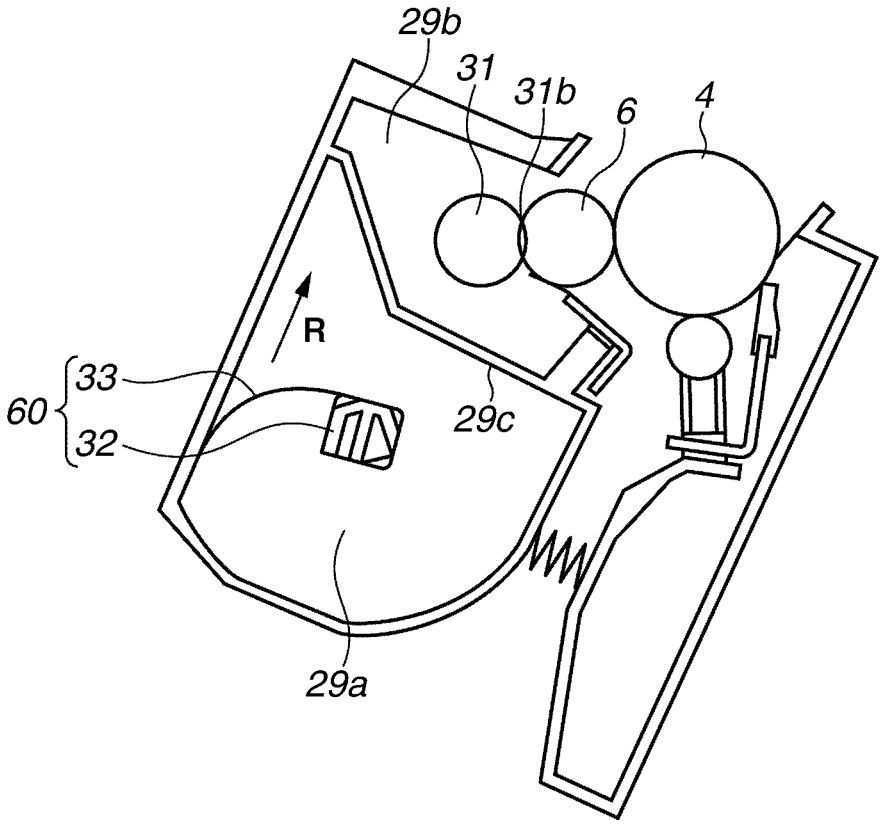
FIG. 12 is a cross-sectional view of a process cartridge according to a fourth exemplary embodiment.

Hereinbelow, referring to FIG. 12, a configuration according to a fourth exemplary embodiment will be described. In the first exemplary embodiment described above, the toner container 29*a* is disposed above (upper side) the position at which toner (developer) is supplied to the developing roller 6. On the other hand, in the present exemplary embodiment, the toner container 29*a* is disposed below (lower side) the position at which toner is supplied to the developing roller 6. More specifically, in the present exemplary embodiment, toner is supplied to the developing roller 6 at a contact portion 31*b* of the supply roller 31 to the developing roller 6. The toner in the toner container 31*b* is positioned below the position of the contact portion 31*b*.

In the present exemplary embodiment, the agitation sheet 33 disposed in the toner container 29*a* conveys toner from the toner container 29*a* upward in the vertical direction. The toner conveyed by the agitation sheet 33 is moved in the arrow R direction illustrated in FIG. 12, and temporarily held in a toner holding unit (hereinbelow, simply referred to as a holding unit) 29*b*. The supply roller 31 and the developing roller 6 are provided in the holding unit 29*b*. The supply roller 33 supplies toner held in the holding unit 29*b* to the developing roller 6. The holding unit 29*b* includes a partition wall 29*c* that separates the toner container 29*a* and the holding unit 29*b*.

In this configuration, the agitation sheet 33 lifts up toner in the vertical direction upward to convey the toner. The agitation sheet 33 is brought into contact with the partition wall 29*c* of the toner container 29*a*. In order to increase the toner conveyance capacity by the agitation sheet 33, it is useful to increase the stiffness of the agitation sheet 33, to elongate the agitation sheet 33, or to increase the number of rotations of the agitation blade 60. On the other hand, by the configuration to increase the toner conveyance capacity as described above, the pressure or the collision speed of the agitation sheet 33 to the partition wall 29*c* may increase. In this case, with the shock of the collision of the agitation sheet 33 to the partition wall 29*c*, the process cartridge P, the photosensitive drum 4, and developing roller 6 may moved with the shock. If during image formation, the agitation blade 60 is rotated, the photosensitive drum 4 and the like may vibrate to cause an image defect. Therefore, in the conventional process cartridge designing, it is necessary to design the agitation blade 60 (agitation sheet 33) in consideration of the balance between increasing the toner conveyance capacity and reducing the image defect caused by the shock.

In the present exemplary embodiment, both the position of the holding unit 29*b* and the position at which toner (developer) is supplied to the developing roller 6 are located above the toner container 29*a* in the vertical direction.

In the present exemplary embodiment, similar to the above-described first exemplary embodiment, the agitation blade 60 is rotated when the photosensitive drum 4 and the developing roller 6 are not rotated. In other words, while the photosensitive drum 4 and the developing roller 6 are not forming an image, the agitation blade 60 is rotated. In this way, toner is accumulated in the holding unit 29*b*. Therefore, while the photosensitive drum 4 and the developing roller 6 are rotating, the agitation blade 60 does not need to rotate. As a result, the degree of freedom for designing the agitation blade 60 (agitation sheet 33) of which toner conveyance capacity is increased.

If the image formation is continuously performed and the toner stored in the holding unit 29*b* has become insufficient, the control unit 100 (see FIG. 7) temporarily stops the image formation. Then, the control unit 100 drives the agitation blade 60 to rotate to convey toner from the toner container 29*a* to the holding unit 29*b*. This is similar control to that of the second exemplary embodiment.

In the present exemplary embodiment, the agitation blade 60 is rotated while the photosensitive drum 4 and the developing roller are not rotating, power necessary when the agitation blade 60 is rotated can be reduced.

Figure 13A:
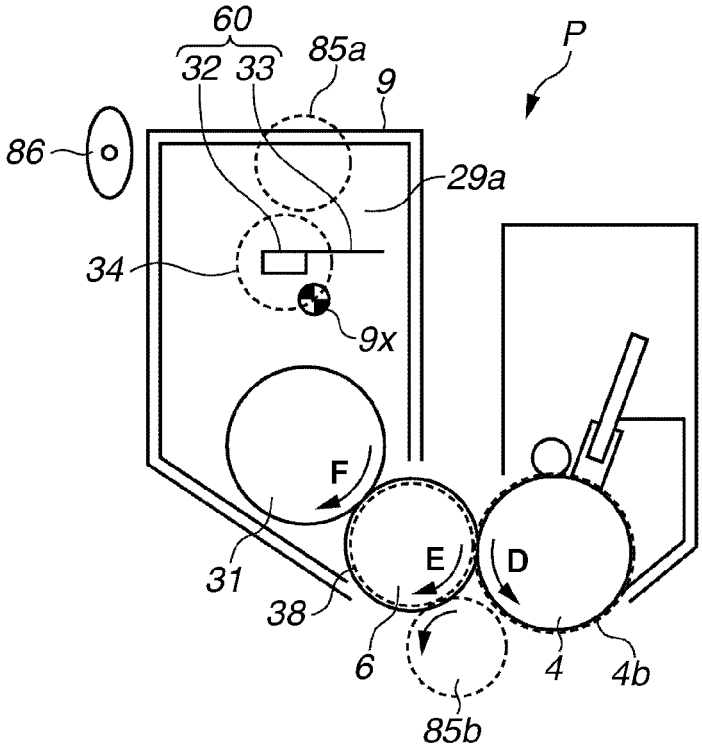
FIGS. 13A and 13B are schematic diagrams of a process cartridge according to a fifth exemplary embodiment.
Figure 13B:
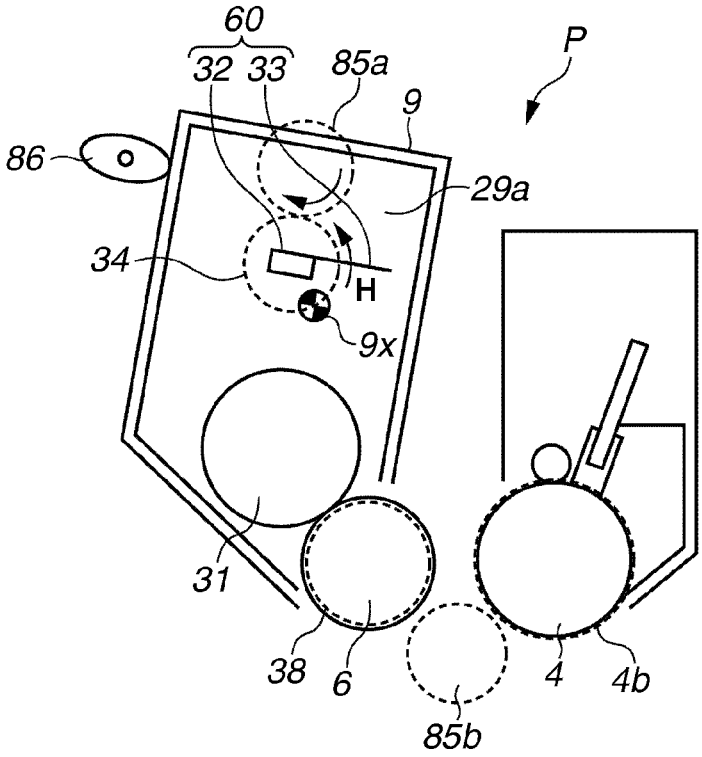

FIGS. 13A and 13B are diagrams schematically illustrating a configuration according to a fifth exemplary embodiment. In the following descriptions, members having similar functions to those of the first exemplary embodiment are designated by the same numerals, and the detailed descriptions thereof may be omitted. Configurations different from those of the first exemplary embodiment will be mainly described.

The feature of the present exemplary embodiment resides in that two states where the developing roller 6 contacts the photosensitive drum 4 and the developing roller 6 separates from the photosensitive drum 4 can be switched. More specifically, a cam 86 is in contact with the developing unit 9. The developing unit 9 is rotatable around a rotation center 9*x*. Interlocking with the rotation of the cam 86, the developing unit 9 can swing to change its orientation. When the developing unit 9 takes the orientation illustrated in FIG. 13A, the developing roller 6 is brought into contact with the photosensitive drum 4. On the other hands, when the developing unit 9 takes the orientation illustrated in FIG. 13B, the developing roller 6 is separated from the photosensitive drum 4. In other words, the cam 86 is a contact/separation mechanism for switching the contact state and the separation state between the developing roller 6 and the photosensitive drum 4.

In addition, the circles illustrated with dotted lines in FIGS. 13A and 13B schematically illustrate gears. Gears 85*a* and 85*b* are provided on the apparatus main body side of the image forming apparatus (see FIG. 1). The agitation shaft gear 34, a drum gear 4*b*, and the developing roller gear 38 are provided on the process cartridge P side.

The agitation shaft gear 34 is attached to the agitation shaft 32 to receive drive force for rotating the agitation blade 60 from the gear 85*a*. The developing roller gear 38 is attached to the developing roller 6 to receive drive force for rotating the developing roller 6 from the gear 85*b*. The drum gear 4*b* is attached to the photosensitive drum 4 to receive drive force for rotating the photosensitive drum 4 from the developing roller 6.

The image forming apparatus 1 according to the present exemplary embodiment includes an interlocking mechanism for switching the agitation blade 60 and the developing roller 6 between the stop state and the rotation state, interlocking with the rotation of the cam 86. The interlocking mechanism includes above-described gears such as the gear 85*a*, the gear 85*b*, the agitation shaft gear 34, the developing roller gear 38, and the drum gear 4*b*.

As illustrated in FIG. 13A, when the cam 86 is separated from the developing unit 9 and the developing roller 6 is brought into contact with the photosensitive drum 4, the agitation shaft gear 34 is separated from the gear 85*a* not to be engaged with the gear 85*a*. Therefore, the agitation blade 60 does not rotate. On the other hand, at that time, the developing roller gear 38 is engaged with the gear 85*b*. Therefore, the developing roller gear 38 receives the drive force to rotate the developing roller 6. Further, the developing roller gear 38 and the drum gear 4*a* are engaged with each other to rotate the photosensitive drum 4.

Next, as illustrated in FIG. 13B, a case where the cam 86 is in contact with the developing unit 9 and the developing roller 6 is separated from the photosensitive drum 4 will be described. At that time, since the orientation of the developing unit 4 is different from the orientation illustrated in FIG. 13A, the agitation shaft gear 34 is engaged with the gear 85*a*. Therefore, the agitation blade 60 is rotated. On the other hand, the developing roller gear 38 and the gear 85*b* are not engaged with each other. Therefore, the developing roller 6 does not rotate (stops). As the developing roller gear 38 does not rotate, the drum gear 4*a* does not rotate either. Thus, the photosensitive drum 4 also in a stopped state.

In other words, the agitation blade 60 is rotatable only when the developing roller 6 and the photosensitive drum 4 are separated. On the other hand, the developing roller 6 and the photosensitive drum 4 are rotatable only when they are in contact with each other.

Since all of the agitation blade 60, the developing roller 6, and the photosensitive drum 4 do not rotate together, power required to rotate each member can be small.

A table illustrating contact/separation state of the developing roller 6 and the photosensitive drum 4 and rotation/stop state of each member is as follows.

TABLE 1

| | rotation state of photosensitive drum | rotation state of developing roller | rotation state of agitation blade |
|---|---|---|---|
| developing roller and photosensitive drum are in contact | rotation | rotation | stop |
| developing roller and photosensitive drum are separated | stop | stop | rotation |

In the present exemplary embodiment, the control unit 100 (see FIG. 7) can control each rotation driving status of the photosensitive drum 4, the developing roller 6, and the agitation blade 60 to be a desired state, only by controlling the rotation of the cam 86.

In addition, arrangements of the gears illustrated in the present exemplary embodiment are just an example and may be changed arbitrarily according to an embodiment. Further, the interlocking mechanism in the present exemplary embodiment is configured only by gears. More specifically, the gears 85*a* and 85*b*, the agitation shaft gear 34, the developing roller gear 36, and the drum gear 4*a* configure the interlocking mechanism. However, a clutch interlocking with the rotation of the cam 86 may be used for configuring the interlocking mechanism. More specifically, interlocking with the oration of the cam 86, the clutch may switch between transmitting the drive force to the agitation blade 60 and not transmitting the drive force to the agitation blade 60. In other words, the image forming apparatus 1 may include the interlocking mechanism with which operations of the clutches 84 and 85 illustrated in FIG. 10 interlock with the rotation of the cam 86.

The interlocking mechanism according to the present exemplary embodiment switches between the rotation state and the stop state (i.e., the drive force is transmitted and not transmitted) of the three members of the developing roller 6, the photosensitive drum 4, and the agitation blade 60 according to the rotation of the cam 86. However, one member or two members of the three members may be switched. Alternatively, the interlocking mechanism may switch the rotation state of the supply roller 33 according to the rotation of the cam 86. For example, in this case, the interlocking mechanism may stop driving the supply roller 33 when the developing roller 6 and the photosensitive drum are separated, and may drive the supply roller 33 to rotate when the developing roller 6 and the photosensitive drum 4 are brought into contact with each other.

At last, effects of exemplary embodiments are summarized as follows. It is possible to perform stable image formation without being influenced by variation of drive load of the agitation member while suppressing increase of the power source in cost and increase in power consumption.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-153651, filed Jul. 9, 2012, which is hereby incorporated by reference herein in its entirety.

What is claimed is:

1. An image forming apparatus configured to form an image on a recording medium, comprising:

a developer container configured to store developer;

an image bearing member configured to be rotated and on which a latent image is formed;

a developer bearing member configured to bear developer and to be rotated to develop the latent image;

an agitation member configured to be rotated to agitate the developer stored in the developer container;

a control unit configured to control the rotations of the image bearing member, the developer bearing member, and the agitation member so as to rotate the agitation member while the image bearing member is not rotated; and a supply roller configured to contact the developer bearing member while rotating to supply developer to the developer bearing member, wherein the agitation member is configured, when rotated, to contact the supply roller.

2. The image forming apparatus according to claim 1, wherein the agitation member is configured, when rotated, to contact an inner wall of the developer container.

3. The image forming apparatus according to claim 1, wherein the control unit is configured to control rotations of the supply roller and the agitation member so as to rotate the agitation member while the supply roller is not rotated.

4. The image forming apparatus according to claim 1, further comprising:

a contact/separation mechanism configured to switch between contact and separation of the developer bearing member with and from the image bearing member;

an interlocking mechanism configured to switch, interlocking with the contact/separation mechanism, between a state where drive force is transmitted to the agitation member and developer bearing member and a state where the drive force is not transmitted to the agitation member and developer bearing member, and wherein when the contact/separation mechanism causes the developer bearing member to be brought into contact with the image bearing member, the interlocking mechanism causes the drive force to be transmitted to the developer bearing member, and not to be transmitted to the agitation member, wherein when the contact/separation mechanism separates the developer bearing member from the image bearing member, the interlocking mechanism causes the drive force not to be transmitted to the developer bearing member, and to be transmitted to the agitation member, and wherein the control unit is configured to control the rotation drive of the developer bearing member and the agitation member by controlling the contact/separation mechanism.

5. The image forming apparatus according to claim 4, wherein the interlocking mechanism is further configured to switch, interlocking with the contact/separation mechanism, between a state where the drive force is transmitted to the image bearing member and a state where the drive force is not transmitted to the image bearing member, and wherein the interlocking mechanism causes the drive force to be transmitted to the image bearing member when the developer bearing member is brought into contact with the image bearing member, and causes the drive force not to be transmitted to the image bearing member when the developer bearing member is separated from the image bearing member, and wherein the control unit is configured to control the contact/separation mechanism to control the rotation drive of the image bearing member.

6. The image forming apparatus according to claim 1, wherein the developer container is disposed above a supply position of developer to the developer bearing member, in a vertical direction.

7. The image forming apparatus according to claim 1, wherein the agitation member is configured to convey developer from the developer container upward in a vertical direction, and and the image forming apparatus further comprising a holding unit configured to hold the developer conveyed from the developer container by the agitation member, and wherein the developer container is disposed below a supply position of toner to the developer bearing member and the holding unit, in a vertical direction.

8. The image forming apparatus according to claim 1, wherein the control unit is configured to drive the agitation member to rotate during a non-image formation period during which the image formation apparatus is not forming an image.

9. The image forming apparatus according to claim 1, wherein the control unit is configured to temporarily stop the image forming operation during continuous image formation on a plurality of recording media, and to drive the agitation member for a predetermined time period.

10. The image forming apparatus according to claim 1, wherein a drive source configured to generate a drive force for rotating at least one of the image bearing member and the developer bearing member and a drive source configured to generate a drive force for driving and rotating the agitation member are different, and each drive force is transmitted to a driving target through a different drive transmission path.

11. The image forming apparatus according to claim 1, wherein at least the image bearing member, the developer bearing member, the developer container, and the agitation member are integrally formed into a cartridge, which is attachable and detachable to and from an apparatus main body of the image forming apparatus.

12. The image forming apparatus according to claim 1, wherein the agitation member includes a sheet configured to contact the supply roller when the agitation member rotates.

13. The image forming apparatus according to claim 1, wherein the control unit is configured to execute a first control for causing the agitation member to rotate when all of the image bearing member, the developer bearing member and the supply roller do not rotate, and to execute a second control for not causing the agitation member to rotate when all of the image bearing member, the developer bearing member and the supply roller rotate.

14. An image forming apparatus configured to form an image on a recording medium, comprising:

a developer container configured to store developer;

an image bearing member configured to be rotated and on which a latent image is formed;

a developer bearing member configured to bear developer and to be rotated to develop the latent image;

an agitation member configured to be rotated to agitate the developer stored in the developer container;

a control unit configured to control the rotations of the image bearing member, the developer bearing member, and the agitation member so as to rotate the agitation member while the image bearing member is not rotated;

a contact/separation mechanism configured to switch between contact and separation of the developer bearing member with and from the image bearing member; and an interlocking mechanism configured to switch, interlocking with the contact/separation mechanism, between a state where drive force is transmitted to the agitation member and developer bearing member and a state where the drive force is not transmitted to the agitation member and developer bearing member, wherein when the contact/separation mechanism causes the developer bearing member to be brought into contact with the image bearing member, the interlocking mechanism causes the drive force to be transmitted to the developer bearing member, and not to be transmitted to the agitation member, wherein when the contact/separation mechanism separates the developer bearing member from the image bearing member, the interlocking mechanism causes the drive force not to be transmitted to the developer bearing member, and to be transmitted to the agitation member, and wherein the control unit is configured to control the rotation drive of the developer bearing member and the agitation member by controlling the contact/separation mechanism.

15. The image forming apparatus according to claim 14, further comprising a supply roller configured to contact the developer bearing member while rotating to supply developer to the developer bearing member, wherein the agitation member is configured, when rotated, to contact the supply roller.

16. The image forming apparatus according to claim 14, wherein the interlocking mechanism is further configured to switch, interlocking with the contact/separation mechanism, between a state where the drive force is transmitted to the image bearing member and a state where the drive force is not transmitted to the image bearing member, and wherein the interlocking mechanism causes the drive force to be transmitted to the image bearing member when the developer bearing member is brought into contact with the image bearing member, and causes the drive force not to be transmitted to the image bearing member when the developer bearing member is separated from the image bearing member, and wherein the control unit is configured to control the contact/separation mechanism to control the rotation drive of the image bearing member.

17. An image forming apparatus configured to form an image on a recording medium, comprising:

a developer container configured to store developer;

an image bearing member configured to be rotated and on which a latent image is formed;

a developer bearing member configured to bear developer and to be rotated to develop the latent image;

an agitation member configured to be rotated to agitate the developer stored in the developer container;

a control unit configured to control the rotations of the image bearing member, the developer bearing member, and the agitation member so as to rotate the agitation member while the image bearing member is not rotated, wherein the developer container is disposed above a supply position of developer to the developer bearing member, in a vertical direction.

18. An image forming apparatus configured to form an image on a recording medium, comprising:

a developer container configured to store developer;

an image bearing member configured to be rotated and on which a latent image is formed;

a developer bearing member configured to bear developer and to be rotated to develop the latent image;

an agitation member configured to be rotated to agitate the developer stored in the developer container, wherein the agitation member is configured to convey developer from the developer container upward in a vertical direction;

a control unit configured to control the rotations of the image bearing member, the developer bearing member, and the agitation member so as to rotate the agitation member while the image bearing member is not rotated;

a holding unit configured to hold the developer conveyed from the developer container by the agitation member, wherein the developer container is disposed below a supply position of toner to the developer bearing member and the holding unit, in a vertical direction.

19. An image forming apparatus configured to form an image on a recording medium, comprising:

a developer container configured to store developer;

an image bearing member configured to be rotated and on which a latent image is formed;

a developer bearing member configured to bear developer and to be rotated to develop the latent image;

an agitation member configured to be rotated to agitate the developer stored in the developer container;

a control unit configured to control the rotations of the image bearing member, the developer bearing member, and the agitation member so as to rotate the agitation member while the image bearing member is not rotated, wherein the control unit is configured to drive the agitation member to rotate during a non-image formation period during which the image formation apparatus is not forming an image.

20. An image forming apparatus configured to form an image on a recording medium, comprising:

a developer container configured to store developer;

an image bearing member configured to be rotated and on which a latent image is formed;

a developer bearing member configured to bear developer and to be rotated to develop the latent image;

an agitation member configured to be rotated to agitate the developer stored in the developer container;

a control unit configured to control the rotations of the image bearing member, the developer bearing member, and the agitation member so as to rotate the agitation member while the image bearing member is not rotated, wherein the control unit is configured to temporarily stop the image forming operation during continuous image formation on a plurality of recording media, and to drive the agitation member for a predetermined time period.

* * * * *